US011992782B1

(12) United States Patent
Hwang et al.

(10) Patent No.: US 11,992,782 B1
(45) Date of Patent: May 28, 2024

(54) TOY VEHICLE LAUNCHER AND TOY VEHICLE TRACK SET

(71) Applicant: Mattel, Inc., El Segundo, CA (US)

(72) Inventors: Jung Jun Hwang, Inglewood, CA (US); Alex Au, Kowloon (HK); Tsz Kin Lim, Yuen Long (HK); Paul Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/305,520

(22) Filed: Apr. 24, 2023

(51) Int. Cl.
*A63H 18/02* (2006.01)

(52) U.S. Cl.
CPC ..... *A63H 18/026* (2013.01); *A63H 18/028* (2013.01)

(58) Field of Classification Search
CPC ..... A63H 18/026; A63H 18/028; A63H 17/44
See application file for complete search history.

(56) References Cited

U.S. PATENT DOCUMENTS 1,473,419 A 11/1923 Cudlipp
3,281,985 A 11/1966 Einfalt
3,457,668 A 7/1969 Genin
3,466,791 A 9/1969 Einfalt
3,545,757 A * 12/1970 Tepper ..... A63H 18/026 446/446
3,593,454 A 7/1971 Einfalt
3,622,158 A * 11/1971 Tepper ..... A63H 18/14 104/162
3,694,953 A * 10/1972 Tomiyama ..... A63H 17/44 446/423
3,750,328 A 8/1973 Nielsen et al.
3,762,095 A 10/1973 Merino et al.
3,782,032 A 1/1974 Glass et al.
3,789,538 A * 2/1974 Spengler ..... A63H 17/44 446/423
3,789,540 A 2/1974 Convertine et al.
3,797,164 A 3/1974 Glass et al.
3,877,169 A 4/1975 Munday et al.
3,905,350 A * 9/1975 Becker ..... A63H 27/14 124/37
3,908,303 A 9/1975 McKay et al.
4,016,674 A 4/1977 Resnick et al.
(Continued)

FOREIGN PATENT DOCUMENTS

EP 2708269 A1 3/2014
EP 2716339 A1 4/2014
EP 2666528 B1 11/2017

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle launcher is movable to a plurality of launching locations disposed along one or more pathways of a toy vehicle track set. The toy vehicle launcher is configured to impart a launching force to a toy vehicle when the toy vehicle launcher is disposed in one of the plurality of launching locations, and the toy vehicle launcher is configured to prevent the launching force from being imparted to the toy vehicle while the toy vehicle launcher is moving between the plurality of launching locations. Additionally or alternatively, the toy vehicle launcher may be configured to impart different launching forces of different magnitudes to the toy vehicle at different locations of the plurality of launching locations.

20 Claims, 20 Drawing Sheets

(56) References Cited

U.S. PATENT DOCUMENTS 4,051,624 A 10/1977 Ogawa
4,108,437 A 8/1978 DeAnda et al.
4,112,610 A 9/1978 Sano
4,128,964 A 12/1978 Ogasawara
4,146,991 A 4/1979 Sano
4,249,733 A * 2/1981 Eddins ..... A63H 18/08 446/444
4,291,488 A 9/1981 Orenstein
4,312,149 A 1/1982 Iwao
4,564,197 A 1/1986 Lambert et al.
4,582,500 A 4/1986 Hanson et al.
4,605,229 A 8/1986 McKay
4,605,230 A * 8/1986 Halford ..... A63F 9/14 273/129 AP
5,709,581 A 1/1998 Rothbarth et al.
5,785,573 A 7/1998 Rothbarth et al.
6,000,992 A * 12/1999 Lambert ..... A63H 18/026 446/444
6,074,269 A 6/2000 Rothbarth et al.
6,402,583 B2 6/2002 Yoneda et al.
6,913,508 B2 * 7/2005 Hornsby ..... A63H 29/24 446/438
7,614,931 B2 * 11/2009 Nuttall ..... A63H 18/026 446/423
7,794,301 B2 9/2010 Ostendorff et al.
7,819,720 B2 * 10/2010 Nuttall ..... A63H 18/028 446/444
7,901,266 B2 3/2011 Ostendorff
8,162,716 B2 4/2012 Nuttall
8,298,038 B2 10/2012 O'Connor et al.
8,430,712 B2 4/2013 O'Connor et al.
8,690,632 B2 4/2014 O'Connor et al.
8,734,200 B2 5/2014 Payne et al.
8,747,180 B2 6/2014 O'Connor et al.
8,801,492 B2 8/2014 O'Connor et al.
8,876,573 B2 11/2014 O'Connor et al.
8,944,339 B2 2/2015 Ostendorff et al.
9,421,473 B2 8/2016 Ostendorff et al.
9,457,284 B2 10/2016 Ostendorff
9,474,982 B2 * 10/2016 O'Connor ..... A63H 18/028
9,504,926 B2 * 11/2016 O'Connor ..... A63H 18/023
9,586,155 B2 3/2017 Hong et al.
11,325,050 B2 5/2022 Womack
2008/0009224 A1 * 1/2008 Nuttall ..... A63H 18/026 446/444
2008/0096460 A1 4/2008 Sandoval et al.
2009/0253349 A1 * 10/2009 Iwakoshi ..... A63H 17/26 446/429
2010/0096509 A1 4/2010 O'Connor
2010/0273390 A1 * 10/2010 O'Connor ..... A63H 18/02 29/428
2010/0330873 A1 12/2010 McCafferty et al.
2011/0081825 A1 4/2011 Jourdian et al.
2011/0263179 A1 * 10/2011 Martino ..... A63H 17/00 446/435
2012/0061484 A1 * 3/2012 Payne ..... A63H 18/10 238/10 A
2012/0276810 A1 11/2012 Grafton et al.
2013/0280987 A1 10/2013 Lennon
2014/0080380 A1 3/2014 Clark et al.
2019/0060772 A1 * 2/2019 Hamel ..... A63H 17/008
2020/0360828 A1 * 11/2020 Han ..... A63H 18/026

* cited by examiner

TOY VEHICLE LAUNCHER AND TOY VEHICLE TRACK SET

FIELD OF THE INVENTION

The present application relates generally to a toy vehicle launcher and/or a toy vehicle track set including the same.

BACKGROUND

Conventional toy vehicle track sets include one or more sections of track along which a toy vehicle can travel. In some toy vehicle track sets, accessories will act on a toy vehicle as a toy vehicle traverses a track and/or when the toy vehicle reaches the end of a track path (i.e., while the vehicle is stopped). Alternatively, some track sets may not include accessories and may, for example, encourage racing or speed testing. In any case, to create play value, many of these toy vehicle track sets include or are usable with a launcher or booster that can accelerate a toy vehicle along a track, e.g., to create sufficient speed for closed loop racing and/or to reach or traverse an accessory. However, the maximum magnitude of this acceleration is often constant. For example, a user might set the magnitude of this acceleration, after which the booster/launcher will attempt to accelerate all cars to the same magnitude. Consequently, the play value of boosters and launchers may be limited and a need exists for a toy vehicle launcher that further captures the attention and imagination of a user. Similarly, new and unique toy vehicle play sets that have new play patterns are desired.

SUMMARY

A toy vehicle launcher is movable to a plurality of launching locations disposed along one or more pathways of a toy vehicle track set. The toy vehicle launcher is configured to impart a launching force to a toy vehicle when the toy vehicle launcher is disposed in one of the plurality of launching locations. In some instances, the toy vehicle launcher is configured to prevent the launching force from being imparted to the toy vehicle while the toy vehicle launcher is moving between the plurality of launching locations. Additionally or alternatively, the toy vehicle launcher may be configured to impart different launching forces of different magnitudes to the toy vehicle at different locations of the plurality of launching locations. According to some embodiments, the present application is directed to a play set including one of these toy vehicle launchers. Alternatively, the present application may be directed to the toy vehicle launcher alone.

In any case, a toy vehicle launcher that can launch vehicles with different forces allows the toy vehicle to be used with a variety of track arrangements and, thus, adds play value. For example, the toy vehicle launcher might be movable (e.g., vertically) to different areas of a toy vehicle track set that have different stunts (or no stunts) and may be able to create a launching force appropriate for each stunt (or each area without stunts). The toy vehicle may also include various features that enhance the operability of the toy vehicle launcher. For example, in some embodiments, the toy vehicle launcher may provide one or more indications when it is ready to launch, e.g., to prevent a user from becoming frustrated when trying to initiate a launch while the toy vehicle launcher is not in a predetermined launching location. Additionally or alternatively, the toy vehicle launcher may be locked in place during an actuation, e.g., to prevent a trigger actuation from accidentally moving the toy vehicle launcher out of a particular launching location during a launch.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy vehicle launcher presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

Overall, a toy vehicle launcher, and a toy vehicle track set including the same are presented herein. The toy vehicle launcher is movable to a plurality of launching locations, which may be disposed along one or more pathways of a toy vehicle track set. The toy vehicle launcher is configured to impart a launching force to a toy vehicle when the toy vehicle launcher is disposed in one of the plurality of launching locations and, in at least some instances, the toy vehicle launcher is configured to prevent the launching force from being imparted to the toy vehicle while the toy vehicle launcher is moving between the plurality of launching locations. Thus, the toy vehicle launcher will prevent accidental launching between launching locations. Additionally or alternatively, the toy vehicle launcher may be configured to impart different launching forces of different magnitudes to the toy vehicle at different locations of the plurality of launching locations. For example, the toy vehicle launcher may be configured to impart a launching force that is specifically tuned for a specific location so that, for example, a toy vehicle is launched with sufficient speed for a stunt, track length, etc. included at a particular launching location. Among other advantages, this may allow the launcher to be used with a variety of track and/or stunt arrangements, thus increasing the play value of the toy vehicle launcher and/or of track sets including or operable with the toy vehicle launcher.

Figure 1:
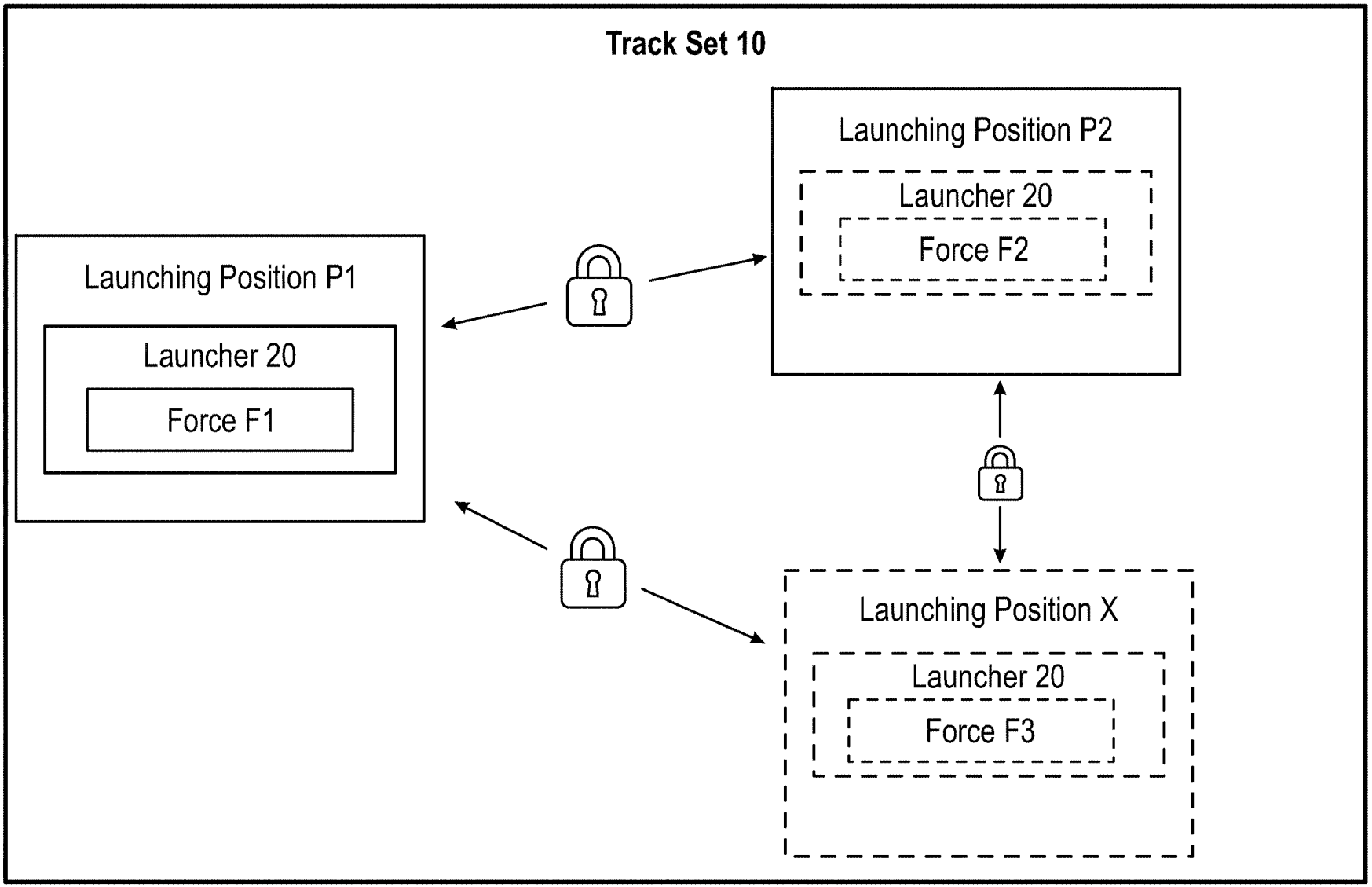
FIG. 1 is a schematic drawing of a track set including the toy vehicle launcher presented herein.

FIG. 1 schematically illustrates the aforementioned concepts. Specifically, FIG. 1 schematically depicts a track set 10 with a toy vehicle launcher 20 that is movable between at least a first launching location P1 and a second launching location P2 (with the launcher being depicted in dashed lines at the second launching location P2 to show that it may move to the second launching location P2). When the toy vehicle launcher 20 (which, for simplicity, may sometimes be referred to as launcher 20) is in the first launching location P1 or the second launching location P2, the launcher 20 is free to impart a force, such as force F1 or force F2, to a toy vehicle to accelerate a vehicle and/or propel the toy vehicle, e.g., along a track. However, notably, when the toy vehicle launcher 20 is between launching locations P1 and P2, the launcher 20 is locked and unable to impart a force to a toy vehicle. Thus, if a user accidentally actuates a launcher trigger while moving the launcher 20 between launching locations P1 and P2, a toy vehicle may remain disposed in the launcher 20 and the user will avoid frustration. This locking may also prevent damage to toy vehicles, the track set 10 and/or the launcher 20.

Moreover, in at least some embodiments, when the launcher 20 is in the first launching location P1, the launcher 20 can launch a toy vehicle with a force F1 of a first magnitude. Then, when the launcher 20 is in the second launching location P2, the launcher 20 can launch a toy vehicle a force F2 of a second magnitude, which may be larger or smaller than the first magnitude of force F1. For example, launching location P1 may be positioned at the bottom of a hill while launching location P2 is partially up the hill. Thus, force F1 may be larger than force F2 so that a toy vehicle can be propelled to the top of the hill from multiple locations without having excessive speed that causes the toy vehicle to jump when it reaches the top of the hill. Alternatively, forces F1 and F2 may be specifically tuned to stunts, track lengths, or any other feature or characteristic of a toy vehicle track set included at a specific launching location (e.g., a force sufficient to allow a toy vehicle to complete a stunt, traverse a track length, etc.).

Still further, a track set incorporating the concepts presented herein need not include only two launching locations. Instead, track set 10 may include two or more launching locations. To illustrate this schematically, FIG. 1 includes launching location X shown in dashed lines. Launching location X may be representative of any additional launching locations included in toy vehicle track set 10. In some instances, the launcher 20 may be movable from one launching location, such as launching location P1, to any other launching location, such as launching location P2 or launching location X. However, in other embodiments, movement may need to be sequential—i.e., from launching location P1 to launching location P2, to launching location X (and X1, X2, etc.), and vice versa. Regardless, the launcher 20 may be locked while moving between launching locations and may be unlocked/activated (e.g., able to impart a launching force) when it reaches a designated launching location. Additionally or alternatively, while the launcher 20 may generate launching forces of different magnitudes in at least two launching locations, the launcher 20 need not generate launching forces of different magnitudes in every different launching location (but may).

Figure 2:
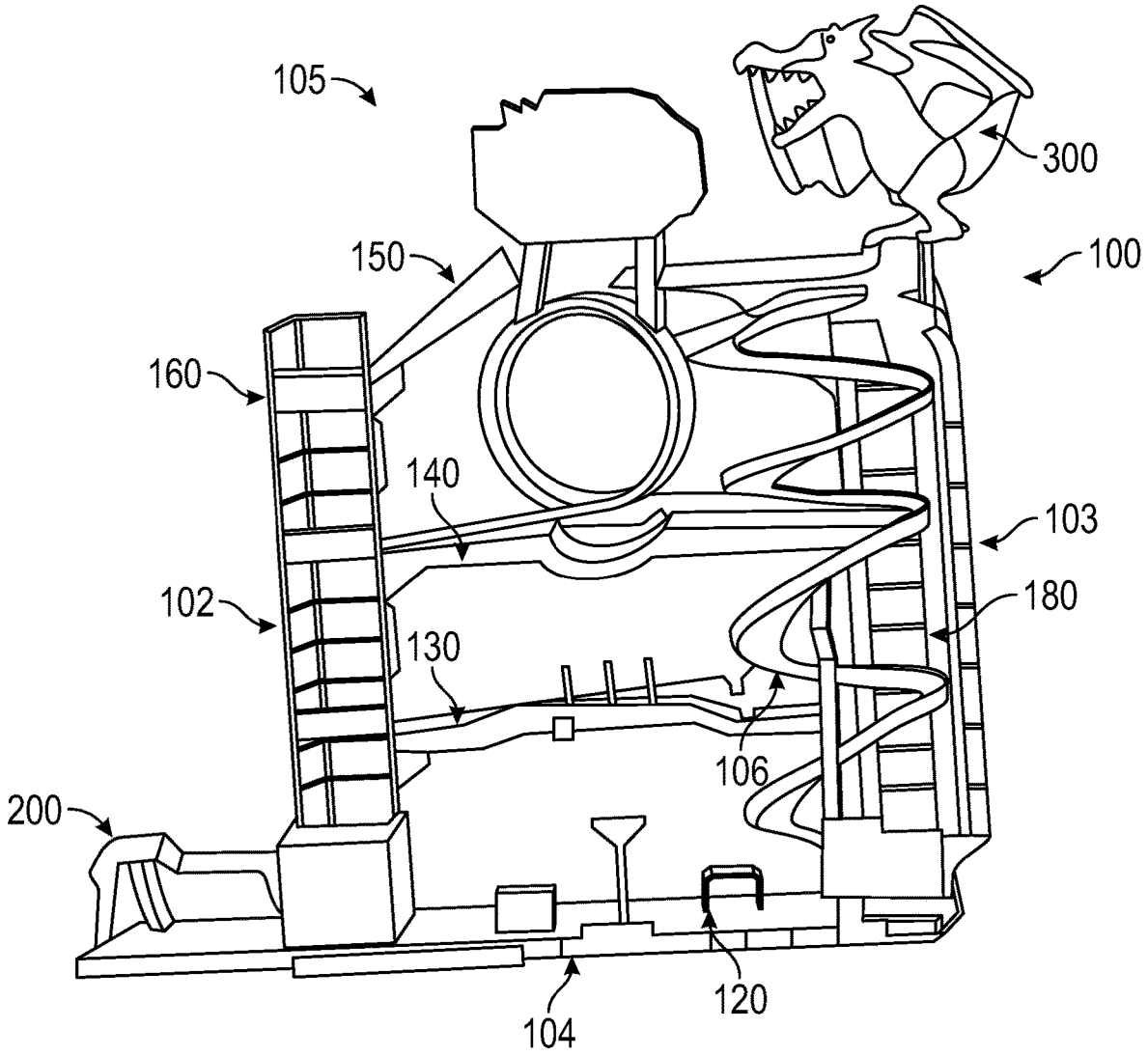
FIG. 2 illustrates a front perspective view of a toy vehicle track set with toy vehicle launcher formed in accordance with an example embodiment of the present application.
Figure 3:
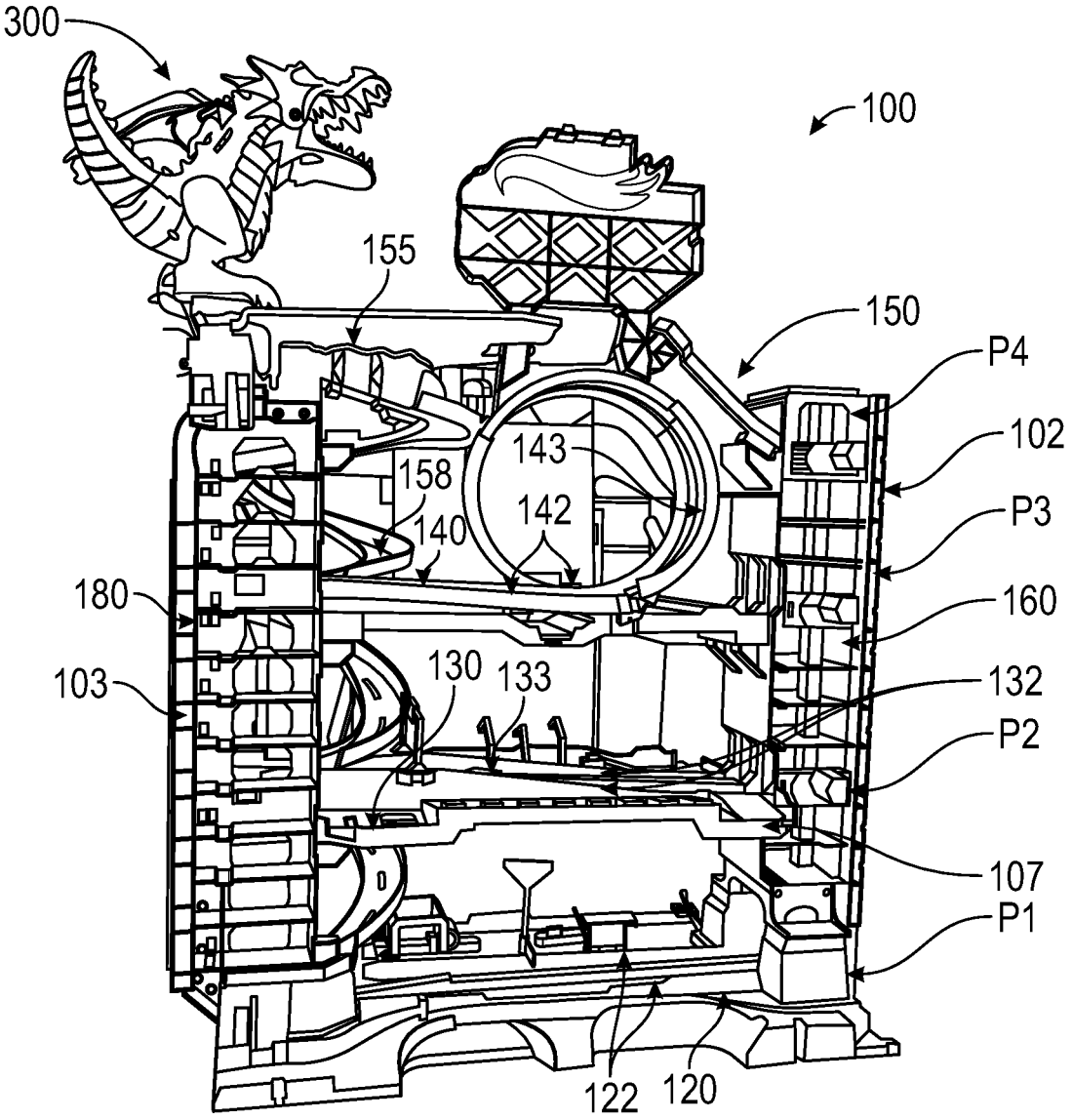
FIG. 3 illustrates a back perspective view of the toy vehicle track set of FIG. 2

FIGS. 2 and 3 illustrate front and back views of an example embodiment of a toy vehicle track set 100 that can include a launcher formed in accordance with the present application. The toy vehicle track set 100 generally extends from a first side 102 (also referred to as a left side) to a second side 103 (also referred to as a right side), from a bottom 104 to a top 105, and from a front 106 to a back 107. In the depicted embodiment, the launcher 200 is generally disposed along the first side 102 and is movable between the bottom 104 and the top 105 of the toy vehicle track set 100. However, to reiterate, toy vehicle track set 100 is merely one example. In other track sets, the launcher 200 could be movable around/along the track set in any manner (e.g., side to side, front to back, and/or in multiple directions). That said, with the depicted arrangement, toy vehicles are generally launched from the first side 102 towards the second side 103, but may also be able to move vertically between the bottom 104 and the top 105.

More specifically, the toy vehicle track set 100 includes a base 120 that generally extends from the first side 102 to the second side 103 and defines or supports one or more track pathways along which toy vehicles can travel. The base 120 also supports a first tower 160 adjacent the first side 102 of the toy vehicle track set 100 and a second tower 180 adjacent the second side 103 of the toy vehicle track set 100. Towers 160 and 180 support a second level 130, a third level 140, and a top level 150 above the base 120, each of which: (a) generally extend from the first side 102 to the second side 103 and (b) define or support one or more track pathways along which toy vehicles can travel.

Additionally, but perhaps most importantly, in toy vehicle track set 100, each of the base 120, the second level 130, the third level 140, and the top level 150 are aligned with launching locations of the launcher 200. Specifically, a first launching location P1 is aligned with base 120, a second launching location P2 is aligned with second level 130, a third launching location P3 is aligned with third level 140, and a fourth launching location P4 is aligned with top level 150. Thus, different launching locations P1-P4 are vertically spaced between the bottom 104 and the top 105 of the toy vehicle track set 100. In the depicted embodiment, the base 120, the second level 130, the third level 140, and the top level 150 each provide different track configurations to create varied track interactions for the different launching locations P1-P4, thereby increasing the play value of the toy vehicle track set 100.

As is shown in FIG. 3, the base 120 includes two lanes 122 (also referred to as pathways) along which toy vehicles may be propelled. The second level 130 also includes two lanes 132 (also referred to as pathways), but adds a diverter 133. The diverter 133 and two lanes 132 create a racing configuration because the diverter 133 reacts to a toy vehicle passing the diverter 133 by closing an opposite lane (e.g., blocking the lane of a slower toy vehicle). Thus, second level 130 may be referred to as a racing level. Meanwhile, the third level 140 and the top level 150 are stunt levels. The third level 140 includes two lanes 142 (also referred to as pathways) that traverse a fixed stunt 143 in the form of a vertical loop. The top level 150 includes an interactive stunt element 300 at which cars may be launched to actuate interesting play patterns and/or actions, as is detailed below.

Still referring to FIGS. 2 and 3, the launching locations P1-P4 are generally defined by first tower 160 in the depicted embodiment. Meanwhile, tower 180 also extends vertically (i.e., longitudinally upwards), from base 120 to support the various levels and to interconnect the base 120, the second level 130, the third level 140, and the top level 150. Thus, tower 180 generally supports a trackway 158 that spans at least a portion of the height of the tower 180. In the depicted embodiment, the trackway 158 also extends generally adjacent the tower 180 as the trackway spirals downwards from a starting point disposed beneath a funnel 155 of the top level 150 and terminates at base 120. However, in other embodiments, the trackway 158 can extend through and/or around tower 180 or extend in any other manner.

In fact, as has been stated repeatedly, toy vehicle track set 100 is merely an example of a track set that may support and/or include launcher 200 and other embodiments may include any features, arrangements, tracks, levels, etc. For example, in other embodiments, the toy vehicle track set 100 need not include trackway 158, tower 180, or any portions or parts associated therewith. Instead, the toy vehicle track set might include various track pathways supported by freestanding supports. Additionally, a track set supporting the launcher presented herein need not include four levels and need not include a tower 160 that supports vertical movement of the launcher 200. For example, launcher 200 could be horizontally or laterally movable, e.g., along a base and/or to different tracks initiating at the same vertical position.

Figure 4B:
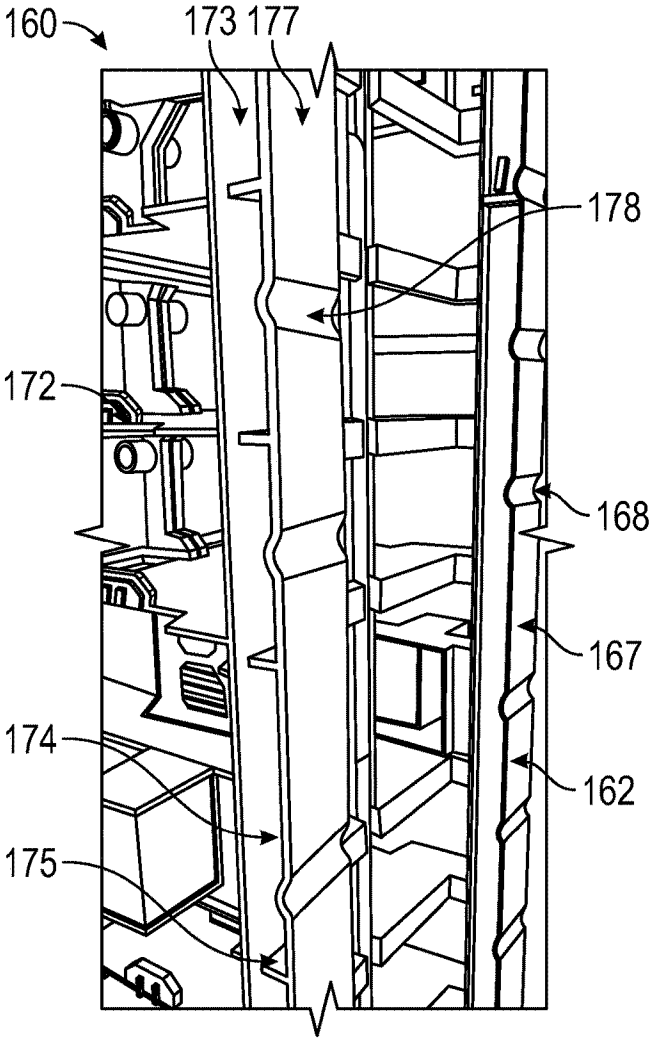
FIGS. 4A, 4B, and 5A illustrate a left side perspective view, a right side perspective view, and a left side view, respectively, of a portion of the toy vehicle track set of FIG. 2.
Figure 4A:
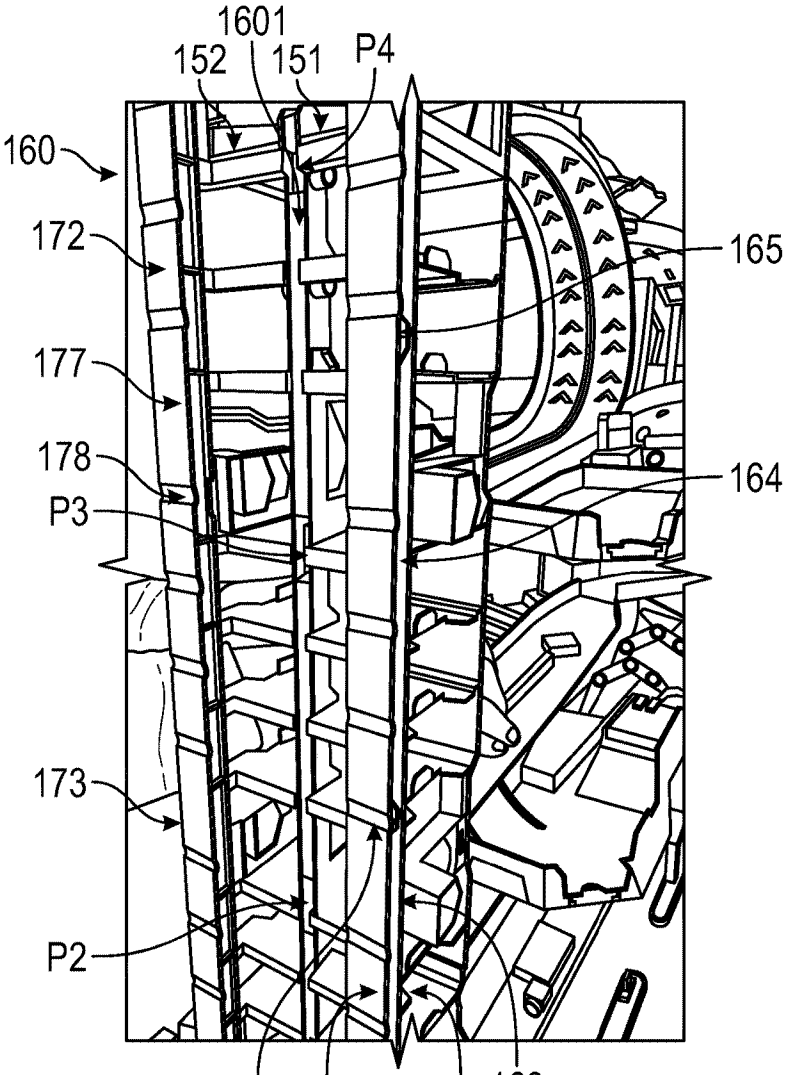
Figure 5A:
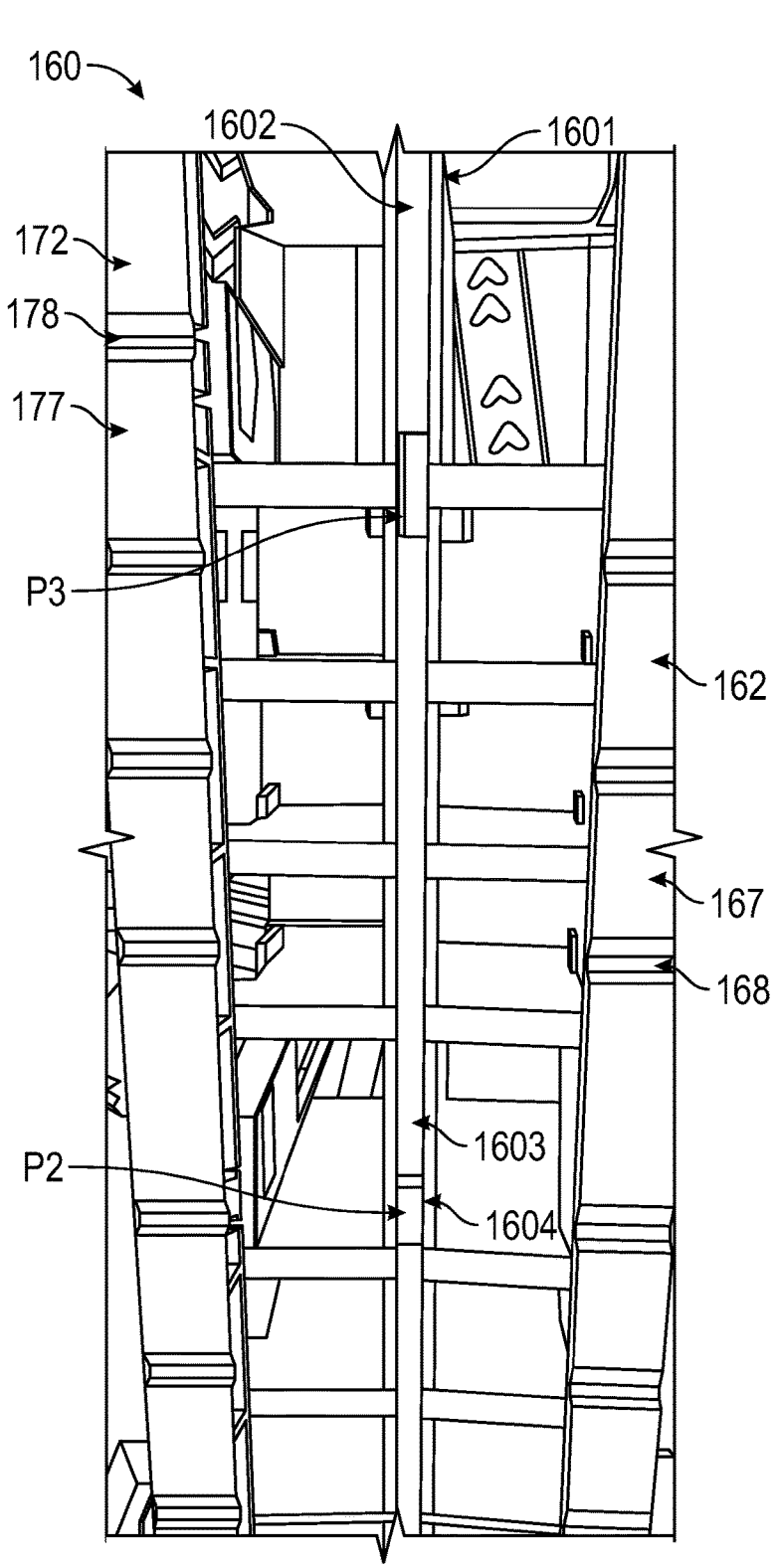

That said, and now turning to FIGS. 4A, 4B, and 5A, the first tower 160 of the depicted embodiment movably supports the launcher 200 along the first side 102 of the toy vehicle track set 100. That is, the first tower 160 allows the launcher 200 to move vertically along the toy vehicle track set 100 (and, thus, first tower 160 may sometimes be referred to as an elevator). Additionally, the first tower 160 defines launching locations P1, P2, P3, and P4. FIG. 4A depicts this tower 160 from a front perspective view (relative to toy vehicle track set 100 as a whole), FIG. 4B depicts tower 160 from a back perspective view, and FIG. 5A depicts first tower 160 from a side view. As can be seen, in the depicted embodiment, the first tower 160 is formed from a front outer stanchion 162, a back outer stanchion 172, and an intermediate stanchion 1601 that extends between the front outer stanchion 162 and the back outer stanchion 172.

The front outer stanchion 162 includes a front face 163 and a side face 167 while the back outer stanchion 172 includes a back face 173 and a side face 177. Side faces 167 and 177 collectively define a surface along which the launcher 200 may vertically translate and includes vertically spaced grooves 168 and 178, respectively, to define various positions for the launcher 200 to stop. As can be seen, some of grooves 168 and 178 are aligned with launching locations P1-P4, but additional grooves are positioned between launching locations P1-P4. These additional grooves define intermediate, non-launching locations in which the launcher 200 may be retained. But, the launcher 200 will not be able to impart a force to a toy vehicle (e.g., propel and/or accelerate) when in these intermediate locations. Instead, these intermediate locations might align the launcher 200 with additional track features, such as parking spots, imaginative play areas, and other such features to allow a user to manually move a toy vehicle off the launcher 200 into these additional track features.

Meanwhile, the front face 163 of the front outer stanchion 162 and the back face 173 of the back outer stanchion 172 may include features that can actuate portions of the launcher 200, e.g., to create an indication, to unlock/activate the launcher 200, and/or to prevent movement of the launcher 200 while the launcher 200 imparts an acceleration/propulsion force to one or more toy vehicles. Specifically, as can be seen in FIG. 4A, the front face 163 includes a channel 164 and interior protrusions 165 that protrude from the channel 164 at intervals aligning with launching locations P1-P4. Meanwhile, as is shown in FIG. 4B, the back face 173 includes a channel 174 and stops 175 that protrude from the channel 174 at intervals aligning with launching locations P1-P4. However, in other embodiments, front face 163 and/or back face 173 may include similar channels and similar protrusions and/or stops (i.e., channel 164 and/or channel 174 may include any combination of stops 175 and protrusions 165). As is described in further detail below, portions of the launcher 200 may sit within the channel 164 and channel 174 while the launcher 200 vertically translates along the first tower 160. Then, the interior protrusions 165 and stops 175 may engage components of the launcher 200 to lock the launcher 200 into a specific location (e.g., launching position P1, P2, P3, or P4), create an indication that the launcher 200 is ready to launch, and/or unlock/activate a launching mechanism 280 of the launcher 200 so that the launcher 200 can impart an acceleration/propulsion force to one or more toy vehicles.

Figure 5B:
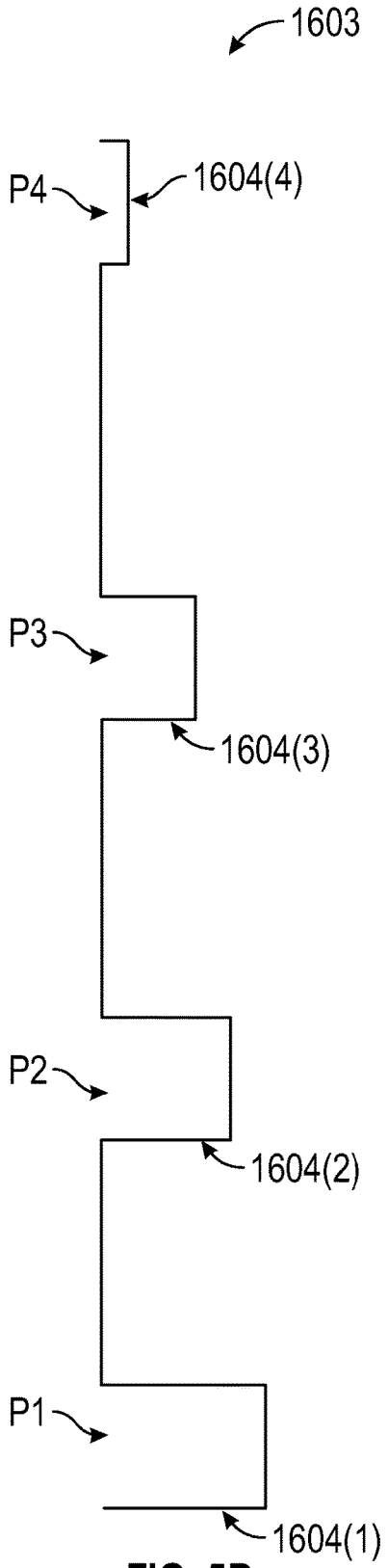
FIG. 5B schematically depicts a control strip shown in FIGS. 4A and 5A.

Now referring to FIG. 5B, but in combination with FIGS. 4A, 4B, and 5A, in the depicted embodiment a side face 1602 of the intermediate stanchion 1601 also interacts with the launcher 200, but acts to control a variable magnitude of the force created by the launcher 200. More specifically, the side face 1602 of the intermediate stanchion 1601 includes a control strip 1603 with indentations 1604 of different depths intermittently arranged along its length (i.e., vertically spaced along the height of the tower 160). The indentations 1604 are positioned to align with launching locations P1-P4 and, thus, also align with a subset of grooves 168 and 178. As is detailed below, each indentation 1604 is configured to activate a force control assembly within the launcher 200 so that the toy vehicle launcher 200 can impart the launching force to one or more toy vehicles. In fact, in the depicted embodiment, a depth of each indentations 1604 is configured to control a variable magnitude of the different launching forces at the different launching locations P1-P4. By comparison, locations on the control strip 1603 without indentations 1604 may be configured to prevent the launcher 200 from imparting an acceleration/propulsion force to one or more toy vehicles.

FIG. 5B schematically illustrates these differing depths in an exaggerated manner. Specifically, in FIG. 5B, a first indentation 1604(1) aligned with the first launching location P1 is deeper (e.g., larger) than a second indentation 1604(2) aligned with the second launching location P2, which is deeper (e.g., larger) than a third indentation 1604(3) aligned with the third launching location P3, which is deeper (e.g., larger) than a fourth indentation 1604(4) aligned with the fourth launching location P4. Thus, the depths of indentations 1604 decrease moving upwards along toy vehicle track set 100 (e.g., upwards along first tower 160). As is detailed below, this may cause the launcher 200 to generate an increasing amount of force as it moves upwards along the toy vehicle track set 100. However, to be clear, FIG. 5B is merely a schematic example and other embodiments need not provide indentations 1604 of decreasing depth and/or need not provide indentations 1604 that decrease in the manner schematically depicted in FIG. 5B. For example, in other embodiments, some indentations 1604 might have the same depth and/or the depths of indentations 1604 may increase or decrease in any manner (e.g., increasing and then decreasing, vice versa, non-uniform changes, or some combination thereof).

But, to reiterate, in other embodiments, the launcher 200 need not move along the first tower 160 and can move along any portion of a track or track set in any manner and if the launcher 200 does move along a tower, such as first tower 160, the tower need not include each and every feature of first tower 160. For example, in other embodiments, first tower 160 might include one stanchion with features that control all aspects of launcher 200 and/or the launcher 200 may be configured to interact with different features than those described in connection with first tower 160. As one example, tower first tower 160 might not include intermediate stanchion 1601 and may control locking, unlocking, and/or force magnitude via features included on other stanchions (e.g., via grooves 168 and/or grooves 178).

Figure 6:
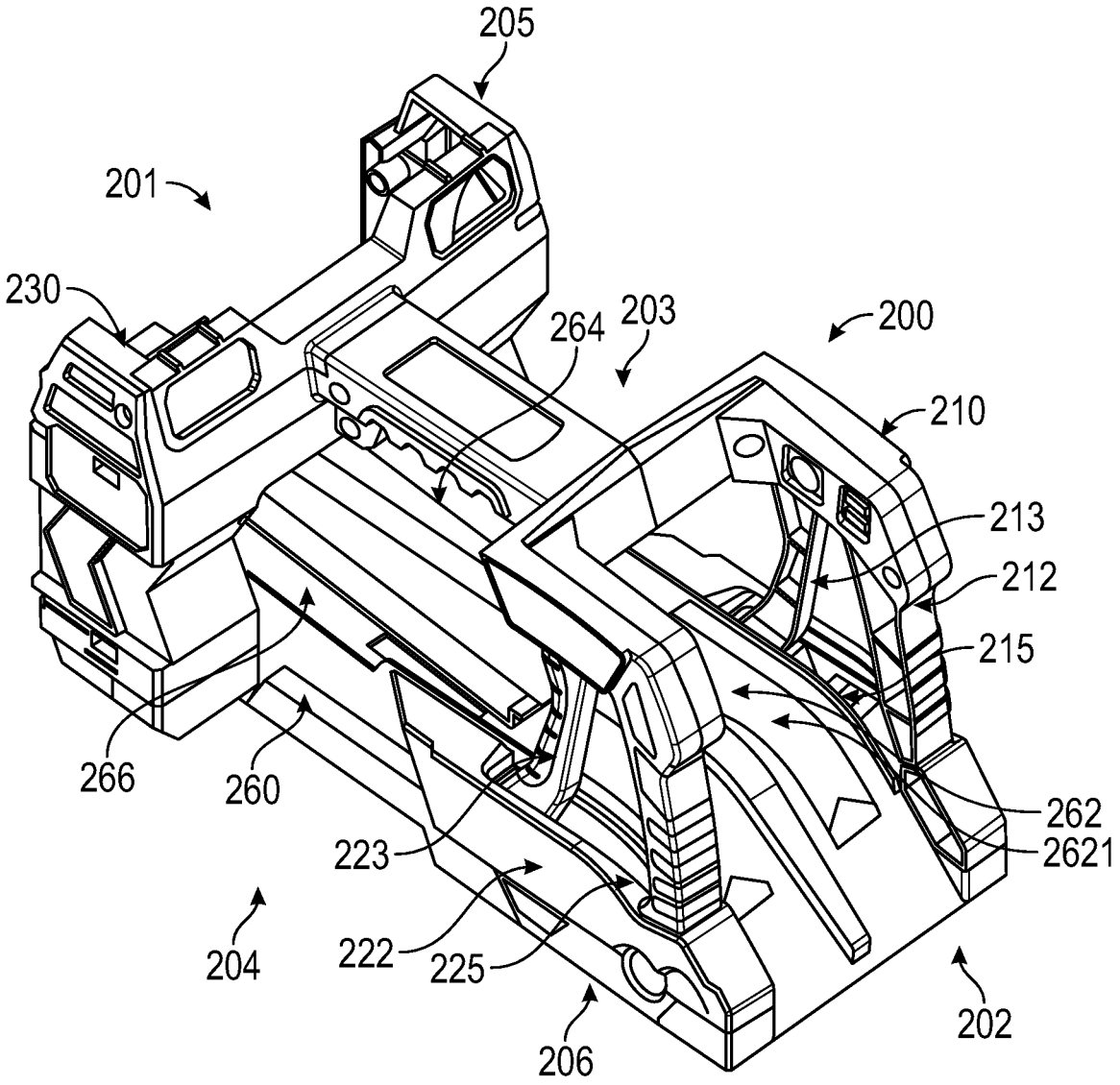
FIG. 6 illustrates a rear perspective view of the toy vehicle launcher included in the toy vehicle track set of FIG. 2, according to an example embodiment.

Now turning to FIG. 6, the orientation of the launcher 200 of the depicted embodiment is generally described with respect to the alignment of toy vehicles disposed therein. Thus, even though the launcher 200 is generally shown on the first side 102 of the toy vehicle track set 100, the launcher 200 is described as extending from a back 202 to a front 201 that faces and generally abuts side faces 167 and 177 of the front outer stanchion 162 and the back outer stanchion 172, respectively, at the first side 102 of the toy vehicle track set 100. Thus, FIG. 6 is considered a back perspective view. Moreover, with this perspective, the width or lateral span of the launcher 200 is generally defined between a first side 203 and a second side 204 of launcher 200 while a height of the launcher 200 is generally defined between a bottom 206 and a top 205 of launcher 200. In the depicted embodiment, a handle portion 210 generally defines the top 205 of the launcher 200 while a base portion 260 generally defines a bottom 206 of the launcher 200. The base portion 260 and handle portion 210 are each coupled to a rider portion 230 that is configured to movably engage the first tower 160.

In the depicted embodiment, the handle portion 210 is relatively open to provide access to launching areas, which are primarily defined by a top surface 2621 of a top cover 262 of the base portion 260. Thus, the handle portion 210 includes a first trigger support 212 that extends from the base portion 260 along the first side 203 of the launcher 200 and a second trigger support 222 that extends from the base portion 260 along the second side 204 of the launcher 200. First trigger support 212 and second trigger support 222 also define the top 205 of the launcher 200 in a frame-like manner and connect to the rider portion 230 at a top 205 of the handle portion 210, thereby defining a stable frame around the base portion 260. This frame-like structure also provides support for a first trigger 213 and a second trigger 223.

The first trigger 213 is configured to translate longitudinally within a first cavity 215 that is disposed on the first side 203 of the launcher 200 (e.g., in a direction extending between front 201 and back 202). Meanwhile, the second trigger 223 is configured to translate longitudinally within a second cavity 225 that is disposed on the second side 204 of the launcher 200. In some embodiments, actuation of the first trigger 213 causes a launching mechanism 280 disposed within the base portion 260 to launch (e.g., impart a acceleration/propulsion force to) a toy vehicle disposed in a first lane 264 of the top surface 2621 while actuation of the second trigger 223 causes the launching mechanism 280 to launch a toy vehicle disposed in a second lane 266 of the top surface 2621. Additionally or alternatively, both of trigger 213 and 223 can be actuated simultaneously to launch two toy vehicles from the first lane 264 and the second lane 266 simultaneously.

Figure 7:
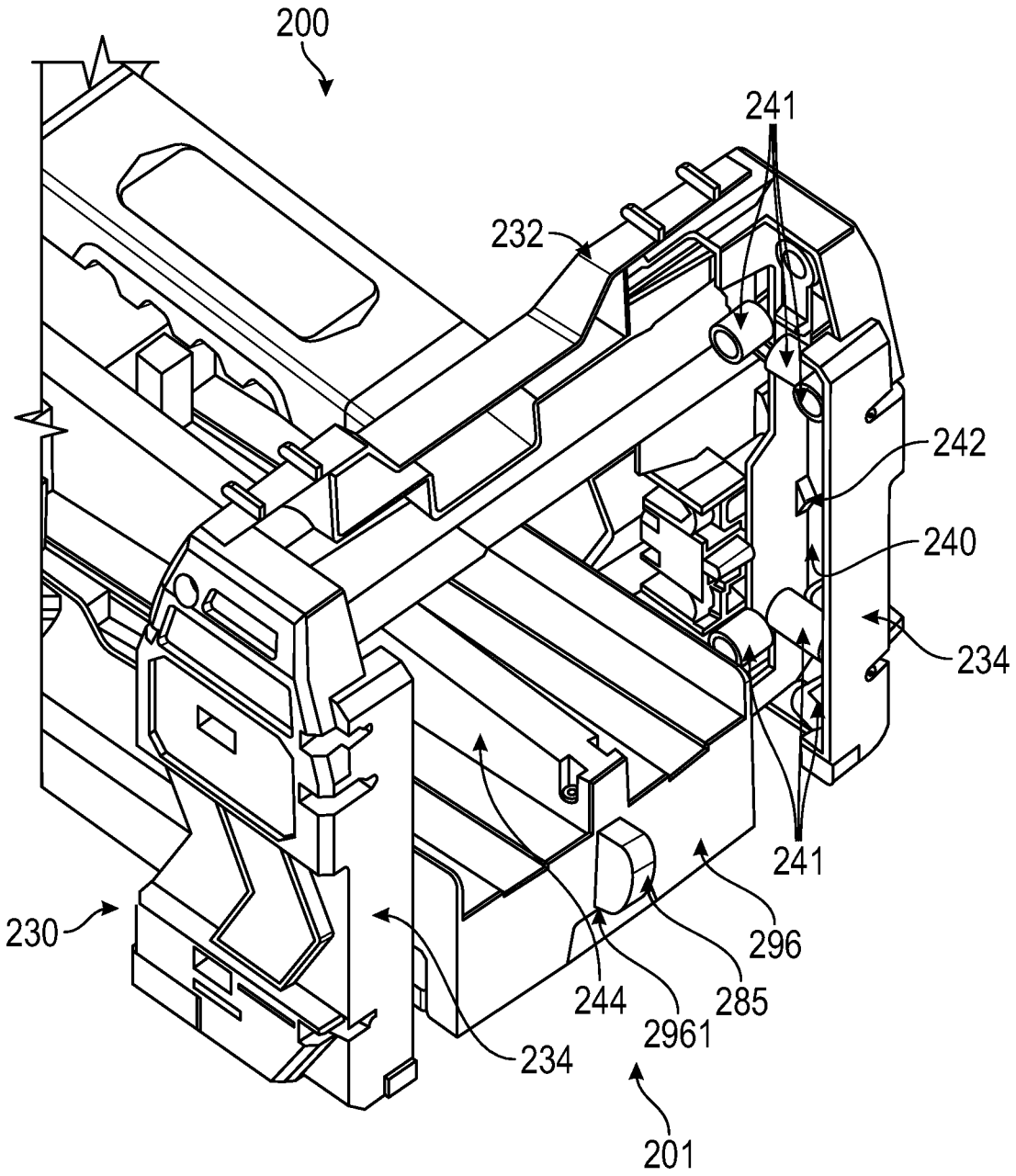
FIGS. 7-9 illustrate perspective views of portions of the of the toy vehicle launcher of FIG. 6, with FIG. 7 illustrating a front perspective view, FIG. 8 illustrating a front perspective view of the toy vehicle launcher with a portion removed, and FIG. 9 illustrating a rear perspective view of a rider portion of the toy vehicle launcher.

FIG. 7 depicts a front perspective view of the rider portion 230 of the launcher 200. As mentioned, the rider portion 230 is generally configured to movably engage first tower 160 so that the launcher 200 can move vertically with respect to the toy vehicle track set 100. In the depicted embodiment, this is achieved by providing a rider portion 230 with a main body 232 that defines a partially annular main body 232 extending around at least a portion of a central opening 244. The central opening. 244 is generally configured to align with the lanes 264 and 266 of the launcher 200 and, thus, allows toy vehicles to travel from the launcher 200 onto a track path defined by the toy vehicle track set 100. Meanwhile, the main body 232 has a front face 234 that defines the front 201 of the launcher 200 and inwardly facing compartments 240 that face the central opening 244. The compartments 240 are configured to align with the front face 163 and the back face 173 of the first tower 160 and house rollers 241 that can slide along the front face 163 and the back face 173, as well as the edges thereof. Put another way, rollers 241 laterally and longitudinally surround the front outer stanchion 162 and the back outer stanchion 172. Finally, but importantly, the rider portion 230 includes a detent 242 in each of the compartments 240. The detents 242 are configured to removably engage grooves 168 and grooves 178 and, thus, can at least temporarily position the launcher 200 in various positions along the height of the first tower 160.

Figure 8:
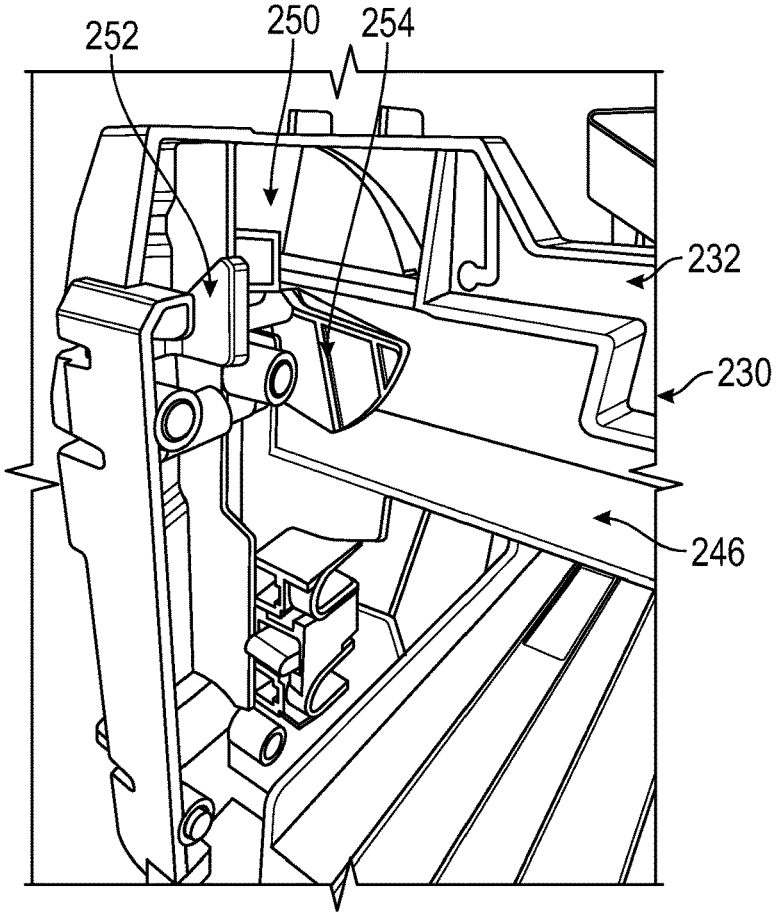
Figure 9:
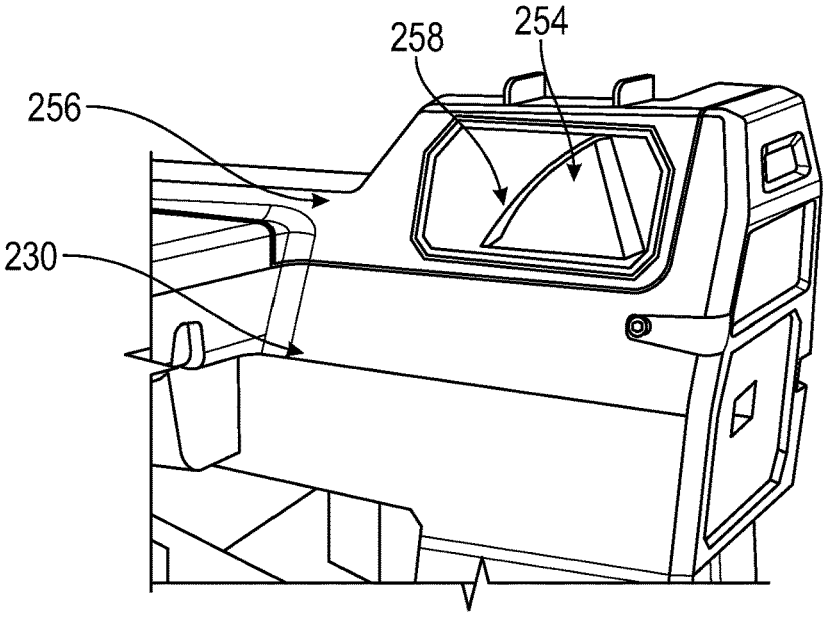

Now turning to FIGS. 8 and 9, in the depicted embodiment, the main body 232 of the rider portion 230 includes an internal compartment 246 that houses an indicator assembly 250. The indicator assembly 250 is configured to indicate when the launcher 200 is in a launching location (i.e., position P1, P2, P3, or P4). Thus, in the depicted embodiment, the indicator assembly 250 includes a cam 252 that is positioned to cause rotation of a launch indicator 254 when the launcher 200 moves the cam 252 into engagement with one of the interior protrusions 165 (see FIG. 4A) included on the first tower 160. As mentioned, interior protrusions 165 are aligned with launching locations P1, P2, P3, and P4 and, thus, the cam 252 will be mechanically actuated at launching locations P1, P2, P3, and P4. This actuation causes cam 252 to rotate the launch indicator 254 to a launch indication position, as is depicted in FIG. 9. As can also be seen in FIG. 9, the rear face 256 of the main body 232 of the rider portion 230 include an opening 258 that exposes the launch indicator 254 when the launch indicator 254 is in a launch indication position. Accordingly, when the launcher 200 is in one of the launching locations P1, P2, P3, and P4, the launch indicator 254 will be visible and when the launcher 200 is another position (e.g., in an intermediate, non-launching location, such as those defined by grooves that are not aligned with launching locations P1, P2, P3, and P4), the launch indicator 254 will not be visible.

Figure 10:
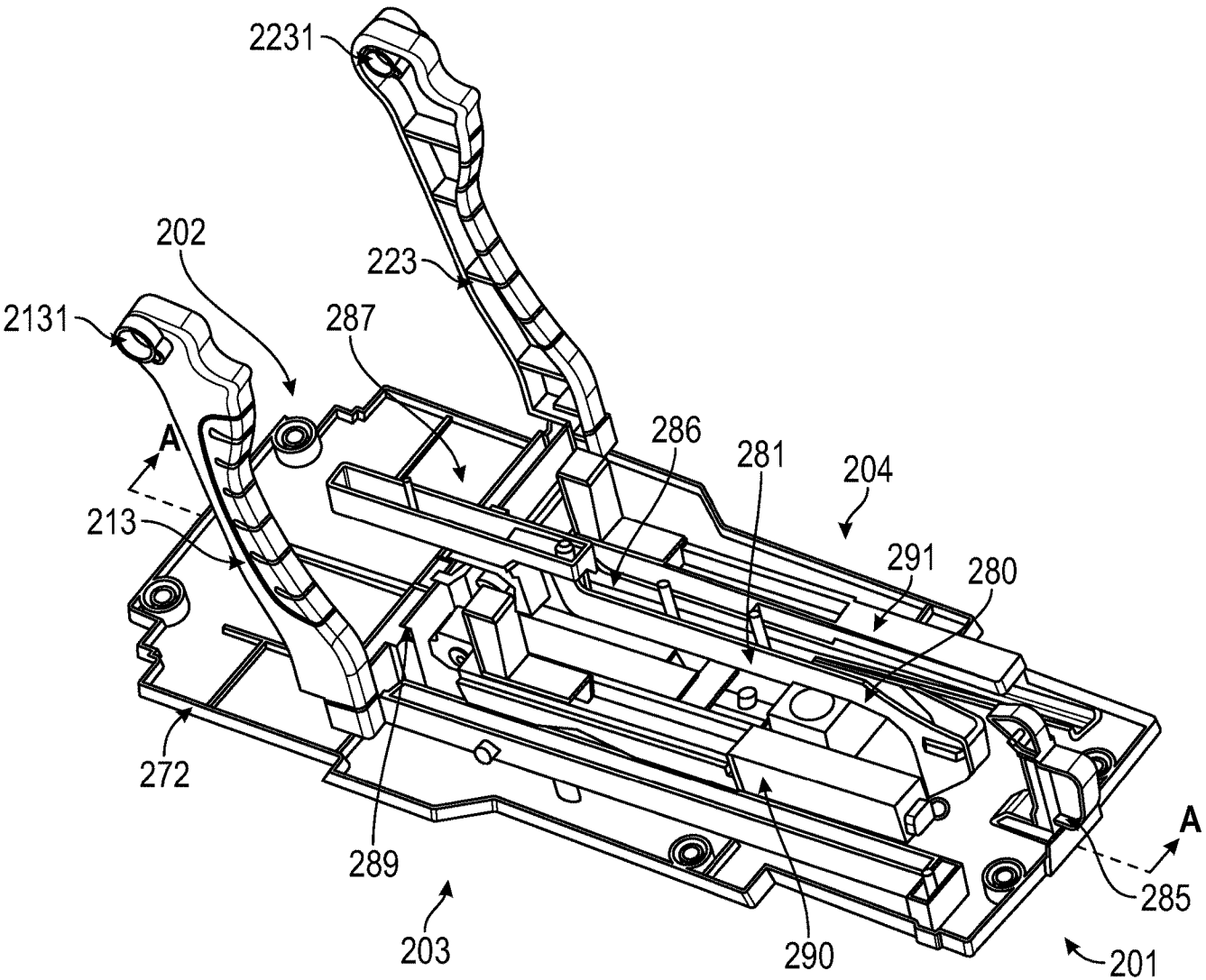
FIG. 10 illustrates a front perspective view of a base portion and triggers of the toy vehicle launcher of FIG. 6, a top cover of the base portion being removed to show a launching mechanism of the toy vehicle launcher.
Figure 11:
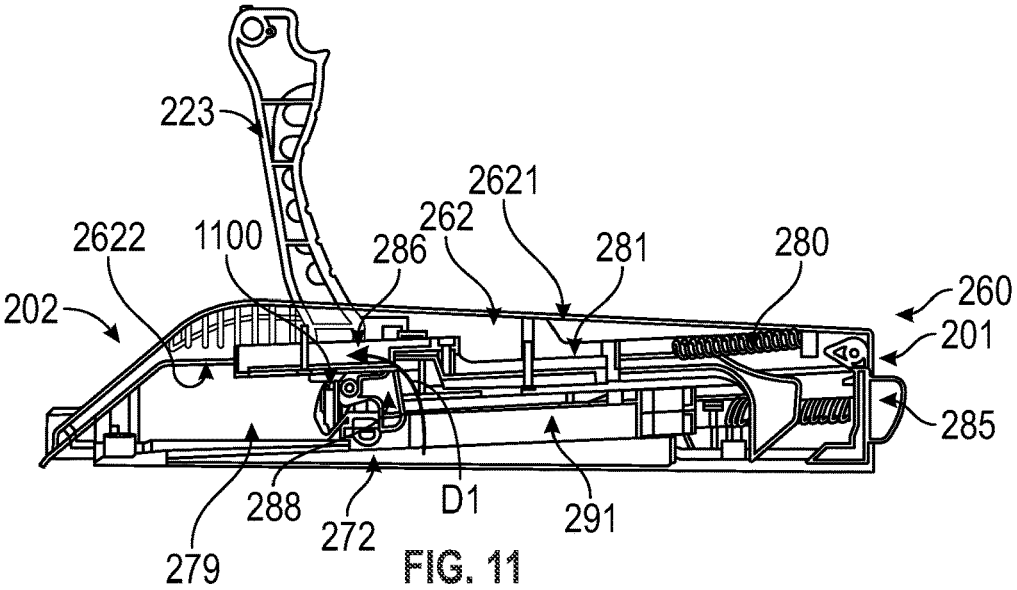
FIG. 11 illustrates a side, sectional of the base portion and the triggers of the toy vehicle launcher of FIG. 6, taken along line A-A of FIG. 10.

Now turning to FIGS. 10 and 11, the base portion 260 of launcher 200 houses the launching mechanism 280 that controls launching/propulsion operations of the launcher 200. More specifically, the launching mechanism 280: (a) allows the launcher 200 to impart a launching force to a toy vehicle when the toy vehicle launcher is disposed in one of the plurality of launching locations; (b) prevents the launcher 200 from imparting a launching force to the toy vehicle while the toy vehicle launcher is moving between the plurality of launching locations; (c) locks the launcher 200 in place during a launch operation; and/or (d) controls a magnitude of the launching force imparted to a toy vehicle at a particular launching location. A state (i.e., position) of the launching mechanism 280 and/or a state of components of the launching mechanism 280 may control these operations.

The launching mechanism 280 is generally disposed within the base portion 260, in an interior cavity 279 defined between a top cover 262 and a bottom cover 272. In FIG. 10, the top cover 262 is removed from the base portion 260 to show the launching mechanism 280. But, top cover 262 is included in the sectional view of FIG. 11. Additionally, while triggers 213 and 223 may, in some instances, be considered part of handle portion 210, triggers 213 and 223 are shown in FIGS. 10 and 11 to illustrate the interplay between triggers 213 and 223 and the launching mechanism 280. Moreover, while the depicted embodiment has two triggers, other embodiments might include one trigger or more than two triggers, any number of triggers may be associated with any number of lanes (e.g., one trigger for one lane or two lanes), and/or any triggers may be operable jointly or independently. That said, two triggers that operate together (i.e., jointly) has generally been found to create stable launching, since it creates simultaneous actuations on both sides of the launcher 200.

In the depicted embodiment, the launching mechanism 280 includes a locking assembly 282, a force control assembly 281, a first booster assembly 290, and a second booster assembly 291. The locking assembly 282 and/or the force control assembly 281 are generally configured to lock or unlock/activate booster assemblies 290 and 291 while the force control assembly 281 may also control an amount of force that may be generated by booster assemblies 290 and 291. In turn, this controls an amount of force that the launching mechanism 280 imparts to a toy vehicle disposed in the launcher 200 (e.g., resting in first lane 264 or second lane 266). However, to be clear, the locking assembly 282 and/or the force control assembly 281 need not always operate the first booster assembly 290 and the second booster assembly 291 jointly and, in at least some instances, the first booster assembly 290 and the second booster assembly 291 may be operable separably.

As can be seen in FIGS. 10 and 11, in the depicted embodiment, the force control assembly 281 generally sits above the first booster assembly 290 and the second booster assembly 291 while the locking assembly 282 is positioned laterally exterior of one of the first booster assembly 290 and the second booster assembly 291. The force control assembly 281 also includes an actuation element 285 that is configured to extend through an opening 2961 included in a front surface 296 of the base portion 260. The actuation element 285 may be biased to a protruding position (e.g., by an unshown resilient element) so that a front end of the actuation element 285 may interact with the first tower 160 to allow or prevent launching in the manner detailed below. Meanwhile, a back end of the actuation element 285 is configured to engage an elongate member 286 that extends over booster assemblies 290 and 291 to operably couple the actuation element 285 to a hammer subassembly 287.

Figure 12A:
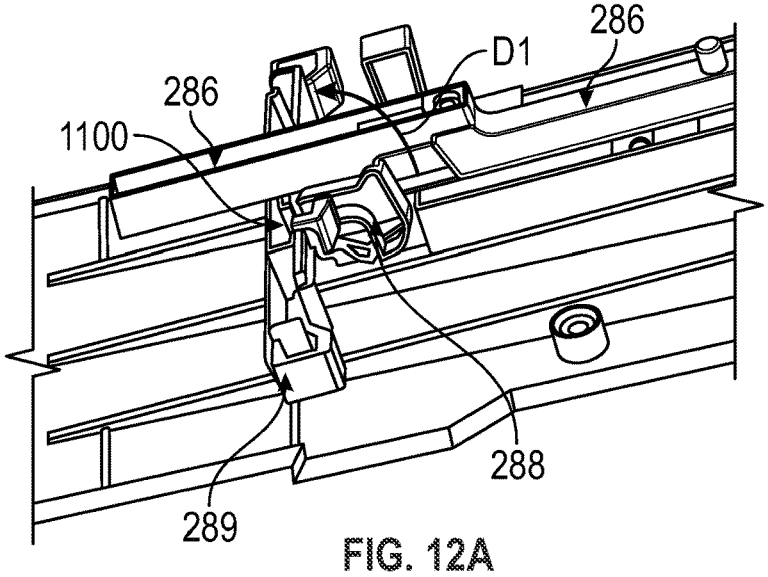
FIG. 12A illustrates a first side perspective view of a portion of a force control assembly of the launching mechanism of FIG. 10, the portion including a hammer subassembly.
Figure 12B:
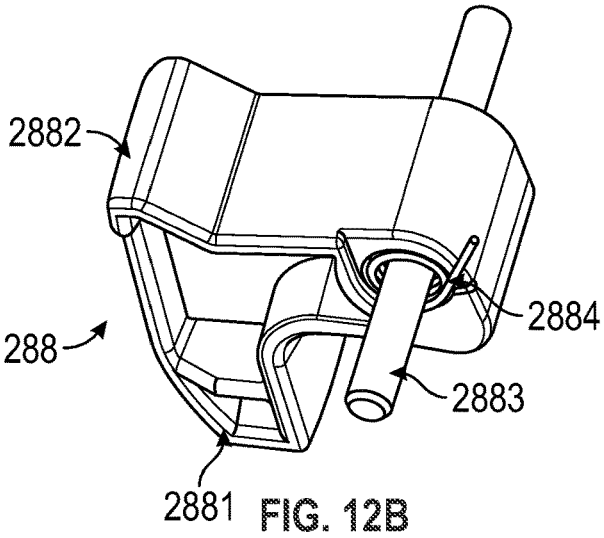
FIG. 12B illustrates components of the hammer subassembly from a second side perspective view that is opposite the first side perspective of FIG. 12A.

Still referring to FIGS. 10 and 11, but now in combination with FIGS. 12A and 12B, the hammer subassembly 287 of the force control assembly 281 includes a hammer 289 and a latch 288. For clarity, FIG. 12A shows the hammer subassembly 287 from a first side perspective view while omitting many other components of launching mechanism 280 and/or base portion 260, such as top cover 262. Meanwhile, FIG. 12B illustrates components of the hammer subassembly 287 from a second side perspective view (an opposite side as compared to the first side perspective of FIG. 12A). As can be seen across these Figures, the hammer 289 extends between the first trigger 213 and the second trigger 223 and is fixedly coupled to a bottom end of each of triggers 213 and 223. Meanwhile, a top end 2131 of trigger 213 and a top end 2231 of trigger 223 may be each be rotatably coupled to the handle portion 210 so that the hammer 289 is translatable in response to trigger actuations that move (e.g., pivot) triggers 213 and 223 relative to top ends 2131 and 2231, respectively (or in response to any other movement or translation of trigger 213 and/or 223).

The latch 288 of hammer subassembly 287 is rotatably coupled to the hammer 289 via an axle 2883 and torsional spring 2884 that biases the latch 288 in direction D1. The torsional spring 2884 biases the latch 288 towards a rest position 1450 (see FIG. 14). But, the elongate member 286 may prevent the latch 288 from moving into its rest position 1450 when the elongate member 286 is disposed above the latch 288—and the latch 288 includes a camming surface 2882 to facilitate engagement with the elongate member 286. On the other hand, if the elongate member 286 is not engaged with the latch 288, the latch 288 can rotate in direction D1. This rotation rotates a launching catch 2881 of the latch 288 out of the booster engaging position 1100 shown in FIGS. 11 and 12A, towards the bottom surface 2622 of the top cover 262 of the base portion 260 (i.e., away from booster assemblies 290 and 291).

Generally, when latch 288 is in the booster engaging position 1100, launching catch 2881 may engage/capture booster assemblies 290 and 291 so that booster assemblies 290 and 291 travel with hammer subassembly 287 if/when the hammer subassembly 287 moves/translates (e.g., in response to an actuation of trigger 213 and/or 223). Alternatively, if the launching catch 2881 rotates in direction D1, it may release the booster assemblies 290 and 291 and allow the booster assemblies 290 and 291 to move separately from the hammer subassembly 287, e.g., to impart launching forces to toy vehicles. Thus, if the latch 288 cannot rotate to its rest position 1450, the latch 288 may prevent the launcher 200 from launching a toy vehicle. In the depicted embodiment, the force control assembly 281 is designed to only permit such a rotation when the launcher 200 is in a predetermined launching location (e.g., launching location P1, P2, P3, or P4). Thus, the force control assembly 281 only allows launching in the predetermined launching locations (e.g., launching location P1, P2, P3, or P4).

Figure 13:
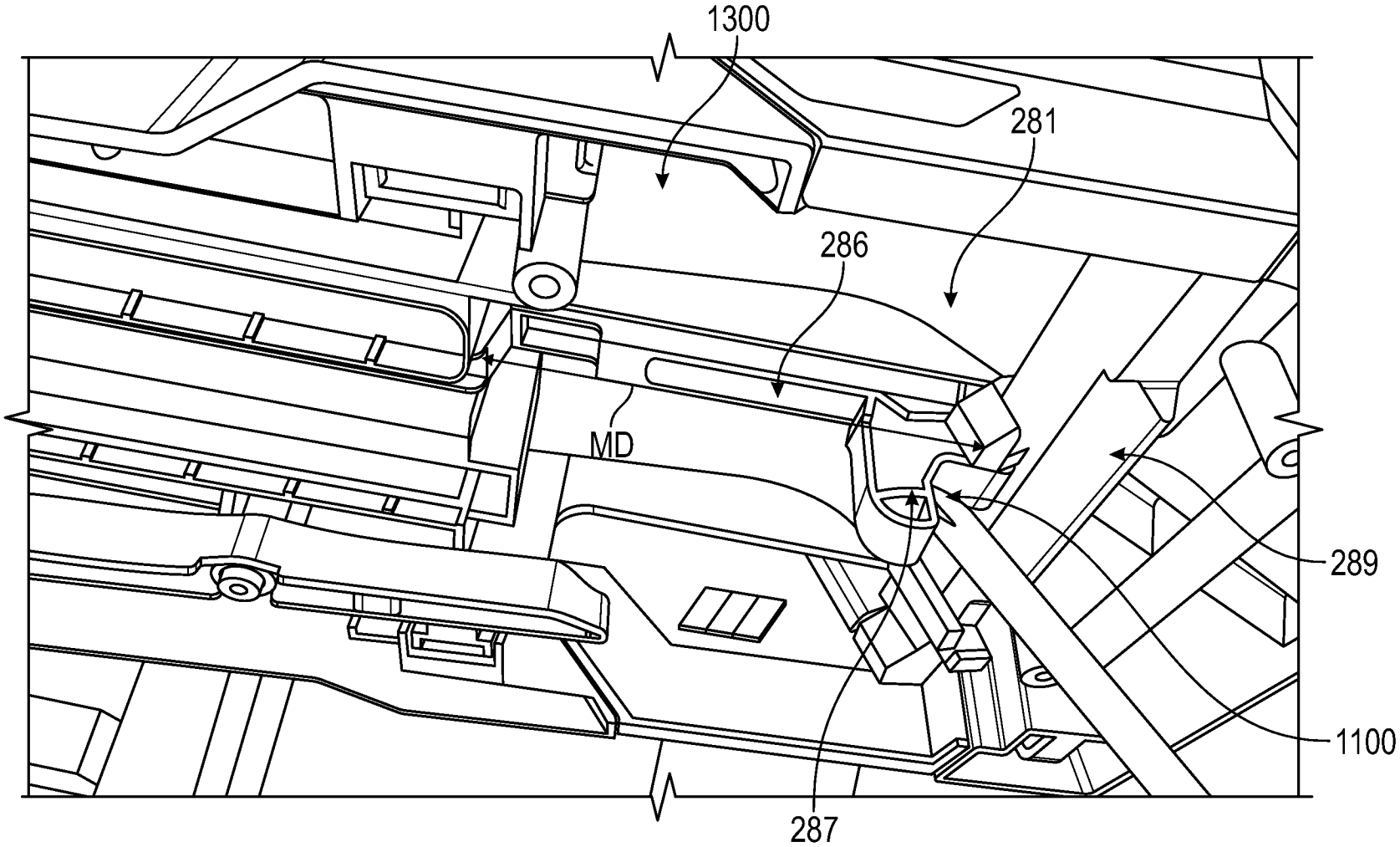
FIGS. 13-15 illustrate bottom perspective views of some components of the base portion of the toy vehicle launcher of FIG. 6, a bottom cover of the base portion being omitted to show the force control assembly of the launching mechanism in different positions.
Figure 14:
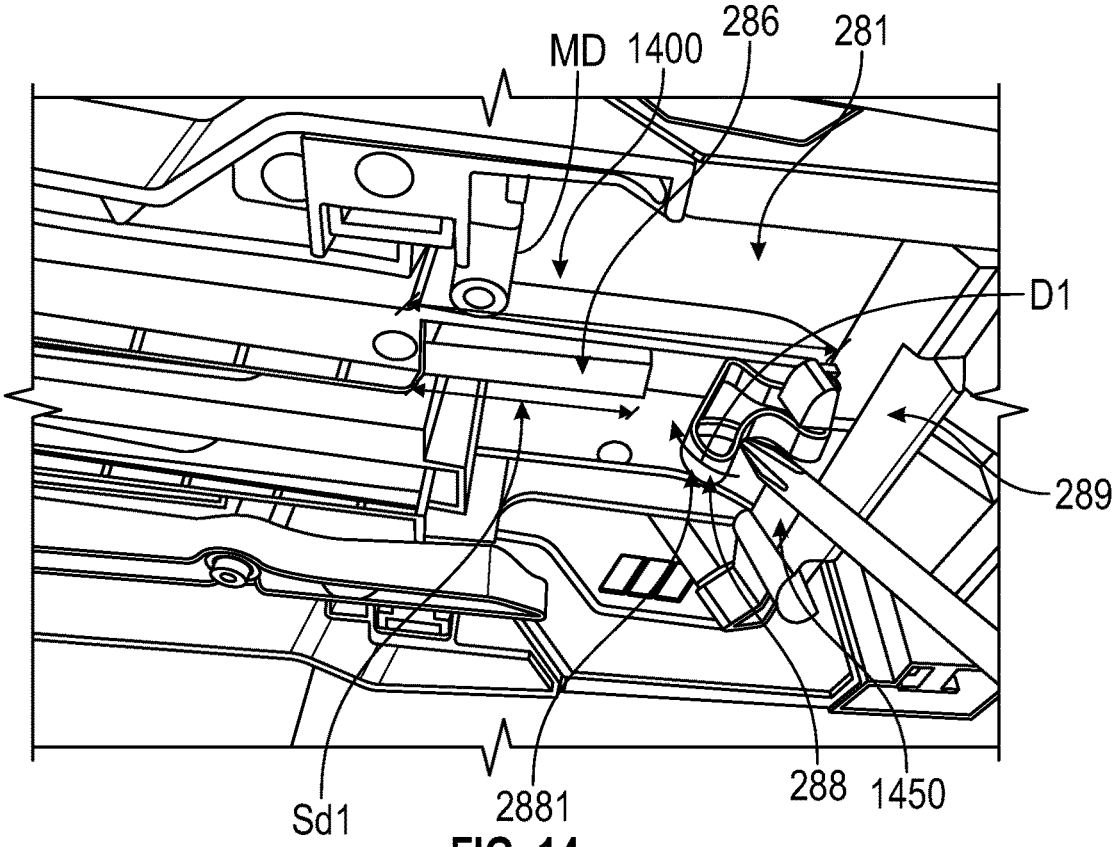
Figure 15:
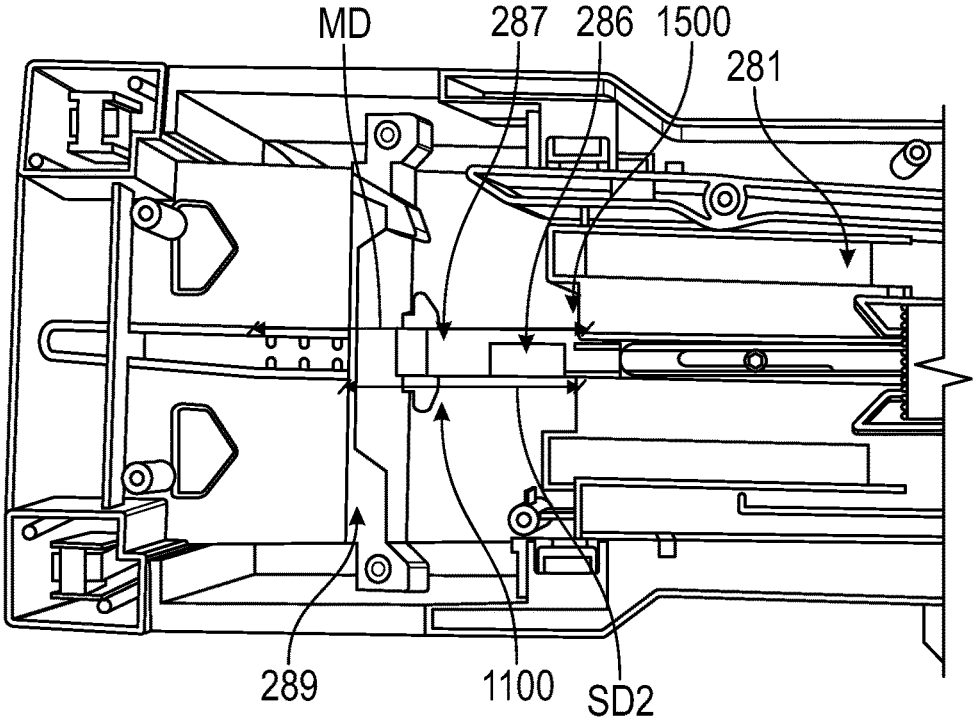

More specifically, and now turning to FIGS. 13-15, but with continued reference to FIGS. 10 and 11 (it may also be helpful to refer to FIGS. 4A, 4B, 5A, and 5B as well), when the launcher 200 is moved into a launching location (e.g., launching location P1, P2, P3, or P4), the force control assembly 281 will be actuated. The magnitude of this actuation may determine the maximum force that the launching mechanism 280 can impart to a toy vehicle. In the depicted embodiment, the magnitude of this actuation is determined by a depth of an indentation 1604 (e.g., on the control strip 1603 of tower 160, see FIGS. 4A, 4B, 5A, and 5B) engaged by the actuation element 285 of the force control assembly 281. FIGS. 13-15 provide examples of such actuations.

First, FIG. 13 depicts a scenario where the actuation element 285 is engaging the control strip 1603 and is not aligned with one of the indentations 1604. In such situations, the actuation element 285 will be fully depressed and will cam the elongate member 286 to a maximum extent, causing the elongate member 286 to be in an extended position 1300 that spans a maximum depth MD beyond a rest position of booster assemblies 290 and 291. The maximum depth MD may span a full travel distance of the hammer 289 so that elongate member 286 is above the latch 288 any time the hammer subassembly 287 is retracted (and for any amount of retraction), e.g., by pulling on trigger 213 and/or trigger 223.

Consequently, when elongate member 286 is in the extended position 1300, the latch 288 will be unable to move beyond the elongate member 286 and will be prevented from rotating out of its engaged position 1100, including in response to actuations of trigger 213 and/or trigger 223. That is, latch 288 will be unable to release the booster assembly 290 and/or booster assembly 291 to allow one or both of booster assemblies 290, 291 to impart a launching/propulsion force to a toy vehicle. Accordingly, the extended position 1300 may generally be described as depicted a force lock position or a no force position. But, to be clear, the extended position 1300 does not necessarily prevent movement of the launcher 200 and/or of trigger 213 and/or trigger 213 thereof; instead, the extended position 1300 prevents the launcher 200 from generating a launching/propulsion force.

By comparison, in FIG. 14 and FIG. 15, the elongate member 286 only spans a portion of the maximum depth MD (distance SD1 in FIG. 14 and distance SD2 in FIG. 15). Thus, the hammer subassembly 287 can move the latch 288 past (and out of engagement with) elongate member 286 to allow the latch 288 to move from its engaged position 1100 towards its rest position 1450 (e.g., due to biasing from torsional spring 2884). The elongate member 286 will move to such positions—e.g., positions 1400 and 1500—when the actuation element 285 (see FIGS. 7 and 10) of the force control assembly 281 is aligned with one of the indentations 1604 of the control strip 1603 (of the intermediate stanchion 1601 of the first tower 160). However, to be clear, positions 1400 and 1500 are merely examples of positions into which indentations 1604 and/or actuation element 285 may move elongate member 286 and even the depicted embodiment may include indentations 1604 that move the elongate member 286 to additional positions (e.g., positions associated with first indentation 1604(1) and third indentation 1604(3)).

Generally, actuation element 285 is biased to extend out of an opening 2961 in the front surface 296 but can be pushed into the base portion 260 when encountering an obstacle, such as control strip 1603. Thus, engagement of the actuation element 285 with the control strip 1603 and/or its indentations 1604 causes translation of elongate member 286. Less extension into indentations 1604 leads to further extension of the elongate member 286 which, in turn, allows the launching mechanism 280 to generate launching forces of greater magnitudes, up until the elongate member 286 spans the maximum depth MD to lock the launching mechanism 280 (i.e., prevent the launching mechanism 280 from generating a launching force). Due to the biasing of actuation element 285, the actuation element 285 and elongate member 286 may be automatically returned to non-cammed positions between indentations 1604.

More specifically, position 1400 (FIG. 14) may illustrate the launcher 200 when aligned with the second indentation 1604(2) of the control strip 1603 at launching location P2 (see FIG. 5B) while position 1500 (FIG. 15) may illustrate the launcher 200 when aligned with the fourth indentation 1604(4) of the control strip 1603 at launching location P4 (see FIG. 5B). In the depicted embodiment, the fourth indentation 1604(4) (launching location P4) may be shallower than the second indentation 1604(2) (launching location P2). Thus, the fourth indentation 1604(4) limits extension of the actuation element 285 beyond the front surface 296 of the base portion 260 as compared to the second indentation 1604(2). That is, the actuation element 285 can extend further beyond the front surface 296 of the base portion 260 when aligned with the second indentation 1604 (2) than it can when aligned with the fourth indentation 1604(4). Accordingly, the fourth indentation 1604(4) may cause the elongate member 286 to extend the distance SD2 that is greater than the distance SD1 of extension caused by the second indentation 1604(2). As mentioned, this means that the fourth indentation 1604(4) and position 1500 of the elongate member 286 may allow the launching mechanism 280 to generate launching forces of greater magnitudes as compared to the launching forces generated at the second indentation 1604(2) and position 1400 of the elongate member 286.

Importantly, both distance SD1 and distance SD2 only cover a portion of the maximum depth MD and, thus, create arrangements where movement of the hammer subassembly 287 can eventually cause the latch 288 to move into its rest position 1450. This will then release booster assemblies 290 and/or 291 to create a toy vehicle launch (i.e., to impart an acceleration/propulsion force to a toy vehicle). The magnitude of force generated by booster assemblies 290 and/or 291 will be directly tied to a latch actuation position that, in turn, is determined by a depth of indentations 1604 in the first tower 160 of the toy vehicle track set 100. More specifically, if latch 288 moves a further distance prior to moving from its engaged position 1100 to its rest position 1450, the force control assembly 281 will allow the booster assemblies 290 and/or 291 to generate higher launch/propulsion forces. As an example, when the elongate member 286 is at position 1500, the force control assembly 281 allows booster assemblies 290 and/or 291 to generate a maximum force that is higher than a maximum force they may generate when the elongate member 286 is at position 1400 (since distance SD2 is larger than distance SD1). But, if the translation distance of elongate member 286 reaches or exceeds a threshold of the maximum depth MD, the camming/translation of elongate member 286 will serve to lock the launching mechanism 280 and prevent the launcher 200 from imparting a force to a toy vehicle.

Figure 16:
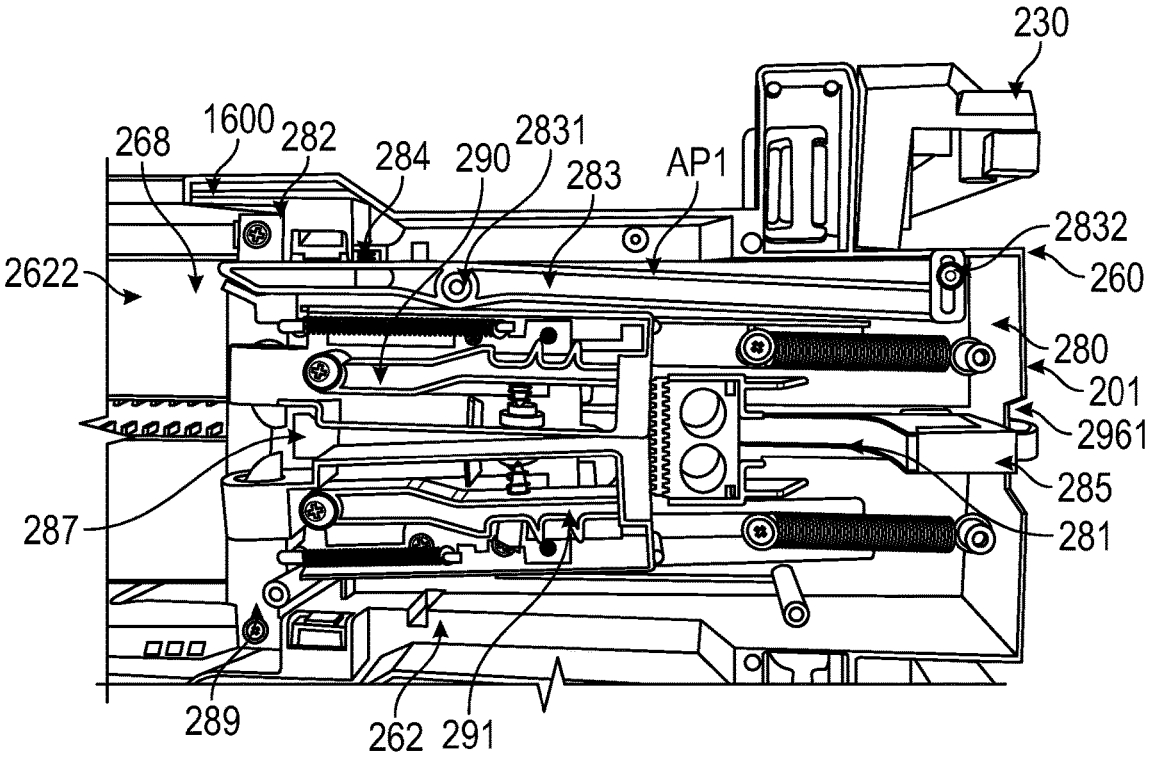
FIGS. 16 and 17 illustrate bottom views of the base portion of the toy vehicle launcher of FIG. 6, the bottom cover of the base portion being omitted to show a locking assembly of the launching mechanism in different positions.
Figure 17:
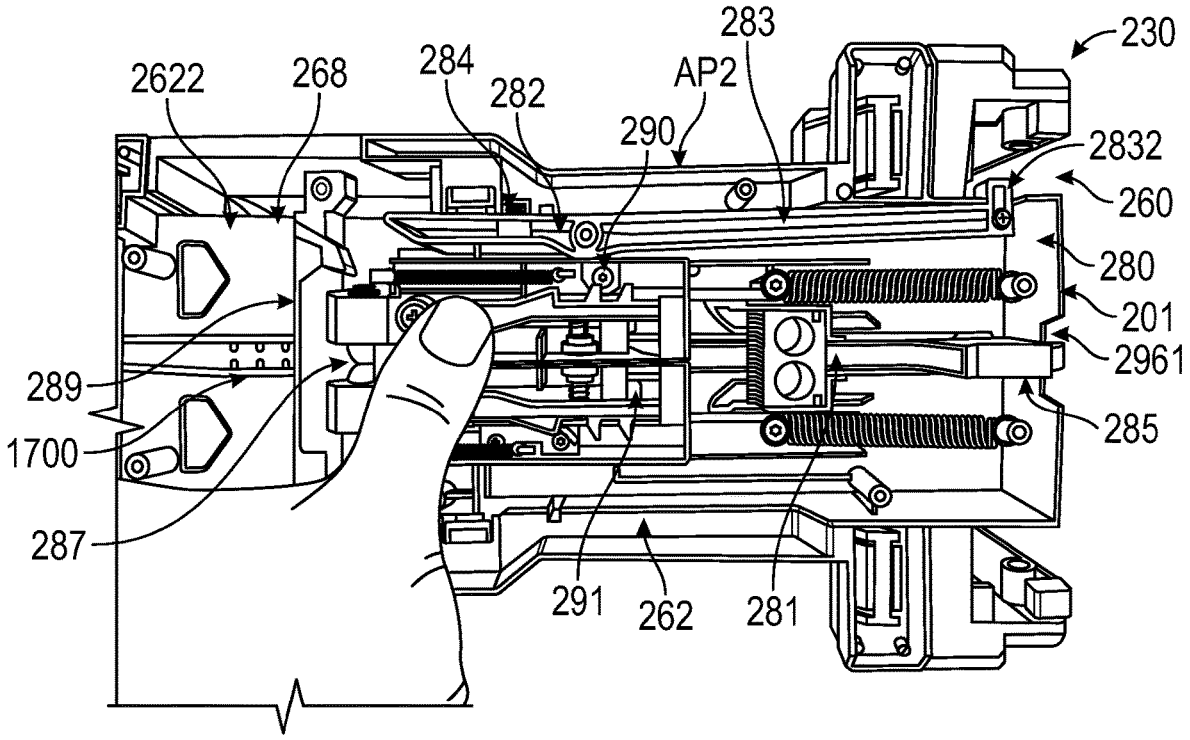

Now turning to FIGS. 16 and 17, in at least some embodiments, the locking assembly 282 can lock the launcher 200 into a particular position during generation of a launching/propulsion force (e.g., launching locations P1, P2, P3, and P4). Additionally or alternatively, the locking assembly 282 might prevent the launcher 200 from generating a launching force until the launcher 200 is in a launching location (e.g., launching locations P1, P2, P3, and P4), either in combination with or instead of force control assembly 281. As can be seen, the locking assembly 282 includes a pivotable arm 283 that is mounted on and pivotable about an axle 2831 so that distal and proximal ends of the pivotable arm 283 can move laterally with respect to booster assemblies 290 and 291. Moreover, the distal end of the pivotable arm 283 is biased towards booster assemblies 290 and 291 by a biasing member 284.

When the hammer subassembly 287 is in a rest position 1600 (see FIG. 16), the hammer 289 engages the distal end to overcome the biasing of biasing member 284 and retains the pivotable arm 283 in disengaged position AP1, as shown in FIG. 16. In position AP1, a proximal flange 2832 of the pivotable arm 283 is positioned substantially interiorly of the base portion 260. Then, when the hammer 289 moves away from the distal end of the pivotable arm 283, an example of which is shown by position 1700 in FIG. 17, the biasing member 284 urges the distal end of the pivotable arm 283 laterally inwards, moving the pivotable arm 283 to an engaged position AP2. In engaged position AP2, at least a portion of the proximal flange 2832 extends exteriorly of the base portion 260. When the proximal flange 2832 is extending exteriorly of the base portion 260, it may, for example, engage a stop 175 included in channel 174 of tower 160 (see FIG. 4B). The engagement between proximal flange 2832 and one of the stops 175 may lock the launcher 200 in a particular position with respect to toy vehicle track set 100.

In the depicted embodiment, the proximal flange 2832 engages one of the stops 175 only in response to movement of hammer subassembly 287 (e.g., to position 1700), which moves in response to movement of trigger 213 and/or trigger 213. Thus, in the depicted embodiment the locking assembly 282 may only temporarily lock the launcher 200 in response to trigger actuations. Then, when trigger 213 and/or trigger 213 is/are released, the hammer subassembly 287 will, due to biasing (e.g., of trigger 213 and/or trigger 213), return to position 1600 and disengage the proximal flange 2832 from the stops 175, freeing the launcher 200 to move with respect to the toy vehicle track set 100 (e.g., allowing vertical movement of launcher 200). Thus, overall, the locking assembly 282 may ensure that the launcher 200 does not moving during a launch of a toy vehicle. That is, if the launcher 200 is in a particular launching location (e.g., location P1, P2, P3, or P4), and begins a launching operation (e.g., by pulling one or both of triggers 213 and 223), the locking assembly 282 may retain the launcher 200 in the particular launching location until the launching operation is complete (e.g., until a propulsion force has been imparted to the toy vehicle). Additionally or alternatively, if desired, the locking assembly 282 may retain the launcher 200 in non-launching positions (e.g., intermediate, non-launching locations) in response to an actuation of trigger 213 and/or trigger 223.

That all said, other embodiments of the launcher 200 presented herein need not include the exact components of locking assembly 282 and may accomplish this locking with variations thereof, in terms of structure, arrangement, and/or operation. For example, the locking assembly 282 need not be positioned to engage back outer stanchion 172 and can engage any portion of a toy vehicle track set 100. As another example, the locking assembly 282 need not engage hammer 289 and could engage any other portion of force control assembly 281.

Figure 18:
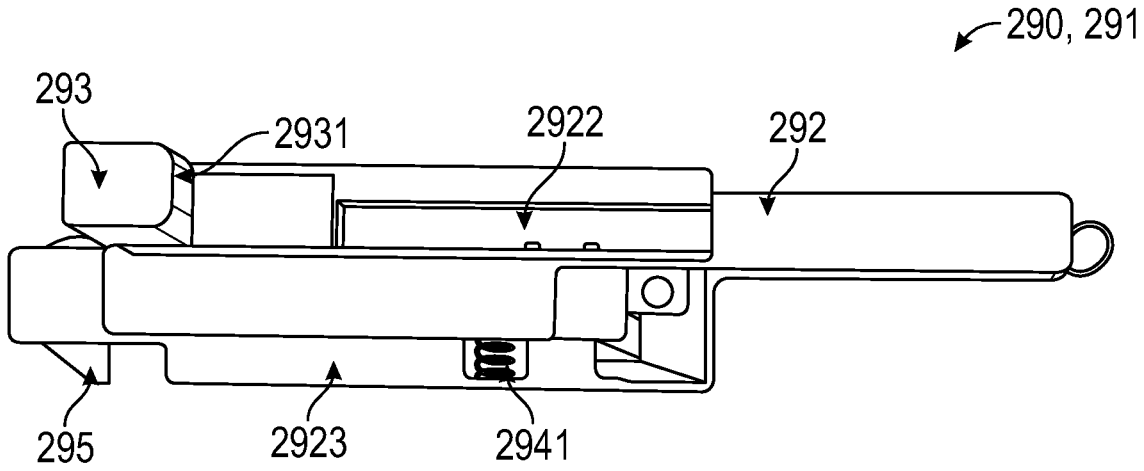
FIG. 18 shows a top view of a booster assembly of the launching mechanism.

Now turning to FIGS. 18-22, these Figures depict booster assembly 290, but are intended to be representative of both booster assembly 290 and booster assembly 291 since booster assembly 290 is a mirror image of booster assembly 291, and vice versa, in the depicted embodiment. That is, for brevity, FIGS. 18-22 show booster assembly 290 and any description thereof should be understood to apply to booster assembly 291 in the applicable manner (e.g., with structural descriptions being understood to be mirrored). FIG. 18 depicts a top view of booster assembly 290, while FIGS. 19-22 depict bottom views of the booster assembly 290 in different positions.

Generally, booster assembly 290 includes a launch member 292, a vehicle engagement member 293, and a retaining portion 294. The launch member 292 generally serves as the main body of the booster assembly 290 and includes a first resilient member 2921, a channel 2922, and a backing 2923. The first resilient member 2921 is configured to bias the launch member 292 to a rest position and the backing 2923 is laterally pivotable with respect to a remainder of the launch member 292. The launch member 292 also includes or is coupled to an inward protrusion 295, with which the force control assembly 281 can interact to cause the booster assembly 290 to generate a specific amount of potential energy that can be converted into a launching force.

The vehicle engagement member 293 sits within the channel 2922 of the launch member 292 and includes an extension 2931, a second resilient member 2932, and a retaining cam 2933. The vehicle engagement member 293 is generally configured to translate within the channel 2922 so that the extension 2931, which extends vertically above the launch member 292 and the top cover 262 of the base portion 260, can interact with a toy vehicle resting thereagainst, e.g., to impart a launching/propulsion force thereto. The second resilient member 2932 extends between the vehicle engagement member 293 and a distal end of the launch member 292. Thus, if the launch member 292 moves with respect to the vehicle engagement member 293 (or vice versa), the second resilient member 2932 can generate potential energy that can be covered into a launching force.

The retaining portion 294 may be coupled to the launch member 292, but may be pivotable thereon (e.g., free to pivot laterally, but otherwise fixed to launch member 292). The retaining portion 294 includes a third resilient member 2941 configured to bias the retaining portion 294 towards the vehicle engagement member 293. The retaining portion 294 also includes a shoulder 2942, a first prong 2943, and a second prong 2944, each of which may selectively engage the retaining cam 2933 of the vehicle engagement member 293.

Figure 19:
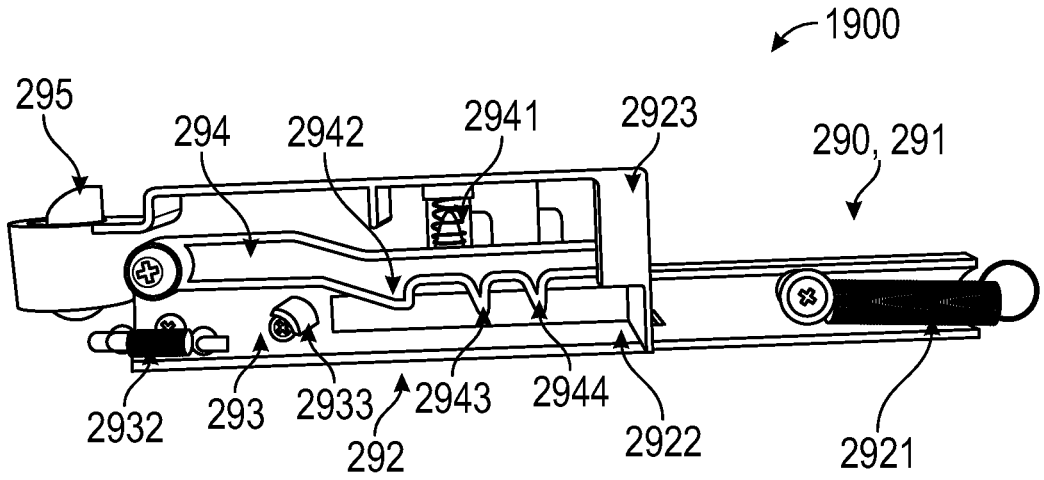
FIGS. 19-22 illustrate bottom perspective views of the booster assembly of FIG. 6 in different positions.

FIG. 19 illustrates the booster assembly 290 in a disengaged position 1900. The booster assembly 290 is in the disengaged position 1900 when the launching mechanism 280 is disengaged, such as when the actuation element 285 of the force control assembly 281 is not in an indentation 1604 and/or when a user is not actuating trigger 213 and/or 223. In this position, the retaining cam 2933 is not engaged with the shoulder 2942, the first prong 2943, or the second prong 2944 of the retaining portion 294. But, the third resilient member 2941 is pushing these features into channel 2922 so that the retaining cam 2933 can engage these components if it moves along the channel 2922 and/or if the channel allows the launch member 292 to move with respect to vehicle engagement member 293. Additionally, in the disengaged position 1900, the first resilient member 2921 and second resilient member 2932 are in rest states (e.g., not stretched).

Figure 20:
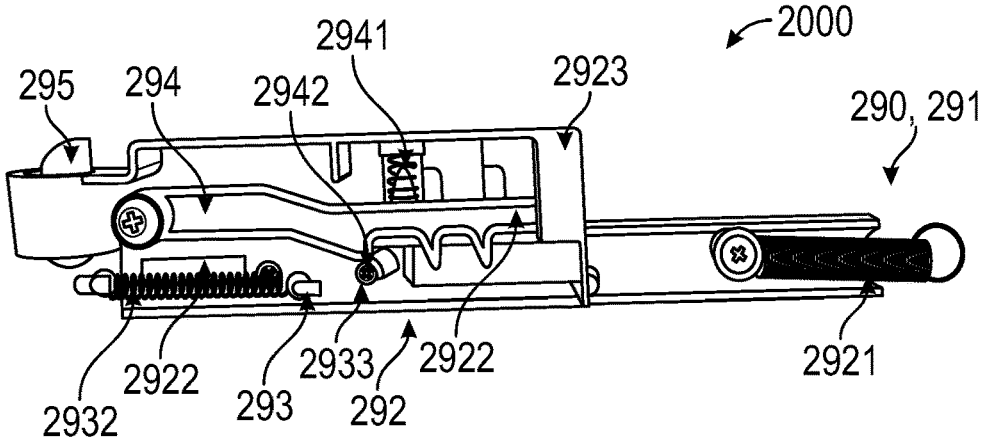
Figure 21:
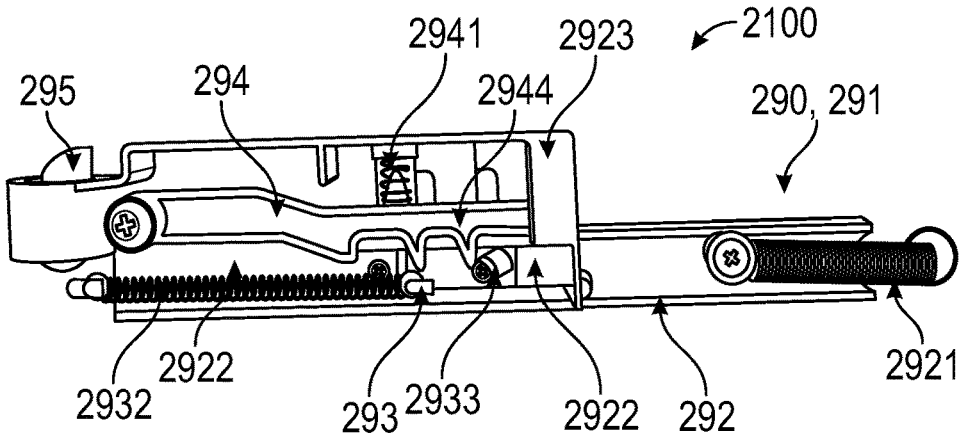

In FIGS. 20 and 21, the booster assembly 290 has stored energy that can be converted into a launching force. In other words, the booster assembly 290 is loaded: in a first loaded position 2000 in FIG. 20; and in a second loaded position 2100 in FIG. 21. In the first loaded position 2000, the retaining cam 2933 is engaged with shoulder 2942 and the launch member 292 has moved a first distance with respect to the vehicle engagement member 293, stretching second resilient member 2932 a first amount. By comparison, in the second loaded position 2100, the retaining cam 2933 is engaged with second prong 2944 and the launch member 292 has moved a second distance with respect to the vehicle engagement member 293, stretching second resilient member 2932 a second amount that is greater than the first amount. Although not pictured, in still another position, the retaining cam 2933 can engage first prong 2943 and the launch member 292 can move with respect to the vehicle engagement member 293 to stretch second resilient member 2932 a third amount that is greater than the first amount but less than the second amount.

Still referring to FIGS. 20 and 21, but now in combination with at least FIGS. 6-17, the booster assembly 290 generally moves into the first loaded position 2000 or the second loaded position 2100 in response to an actuation of trigger 213 and/or trigger 213. As discussed above, actuation of trigger 213 and/or trigger 213 causes the hammer subassembly 287 to translate rearwardly a specific amount. During this rearward translation, the latch 288 of the hammer subassembly 287 may engage the inward protrusion 295 of the booster assembly 290 to pull the booster assembly 290 rearwardly with the hammer subassembly 287.

At the beginning of this rearward translation, the entire booster assembly 290 may begin to translate rearwardly across the base portion 260. This movement may be resisted by first resilient member 2921, which may begin stretching in response to this movement. Eventually, the extension 2931 will reach the distal end of the channel formed in the top cover 262 of the base portion 260 (through which the extension 2931 extends to contact a toy vehicle) and, thus, will be unable to continue moving with the launch member 292 and retaining portion 294. Thus, further rearward movement of the booster assembly 290 will move the launch member 292 and retaining portion 294 with respect to the vehicle engagement member 293 and begin to stretch the second resilient member 2932. As the second resilient member 2932 stretches, the retaining cam 2933 of the vehicle engagement member 293 will move sequentially past the shoulder 2942, first prong 2943, and the second prong 2944.

Due to the position of the third resilient member 2941, each of the shoulder 2942, the first prong 2943, and the second prong 2944 may act as a one-way stop and may retain the retaining cam 2933 thereagainst until the backing 2923 allows disengagement. Thus, the combination of potential energy (e.g., tension) in the second resilient member 2932 and the potential energy (e.g., tension) in the first resilient member 2921 will carefully tune the amount of force that the booster assembly 290 will generate if/when the force control assembly 281 (e.g., the hammer subassembly 287) releases the booster assembly 290 to cause a boost. Thus, in the depicted embodiment, the launching mechanism 280 can generate at least four specific amounts of force, by (1) providing no engagement between retaining cam 2933 and the retaining portion 294; (2) engaging retaining cam 2933 with shoulder 2942; (3) engaging retaining cam 2933 with first prong 2943; and (4) engaging retaining cam 2933 with second prong 2944, with the force increasing moving from (1) to (4). However, if the launcher 200 is not positioned to unlock/activate force control assembly 281 (e.g., in launching position P1, P2, P3, or P4), the booster assembly 290 may not be released to generate these forces (e.g., latch 288 may not disengage from inward protrusion(s) 295).

Figure 22:
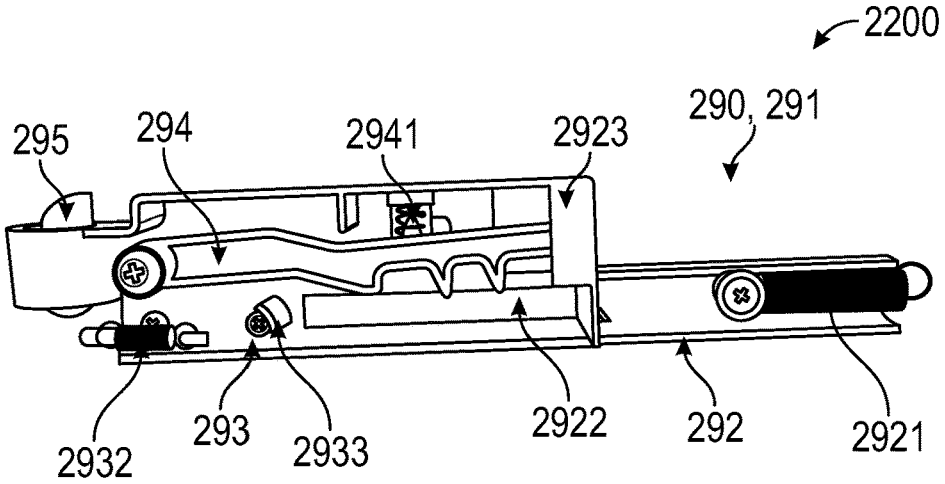

FIG. 22 shows an engagement release position 2200. As mentioned, the retaining portion 294 may be disengaged from the vehicle engagement member 293 (e.g., to disengage the shoulder 2942, the first prong 2943, or the second prong 2944 from the retaining cam 2933) when a biasing force created by third resilient member 2941 is overcome. In some instances, forces created by second resilient member 2932 and/or first resilient member 2921 may be sufficient to overcome the biasing force generated by third resilient member 2941, especially if the geometry of the vehicle engagement member 293 and/or retaining portion 294 encourages such disengagement. Additionally or alternatively, the backing 2923 and/or the retaining portion 294 may pivot to decrease a biasing force generated by third resilient member 2941. For example, backing 2923 may move the third resilient member 2941 further from the retaining portion 294 and decrease its biasing force. In fact, in some instances, the base portion 260 and/or the locking assembly 282 may be specifically designed to increase or decrease an amount of pressure on the backing 2923 and/or the retaining portion 294. That is, the base portion 260 and/or the locking assembly 282 may control how/when the backing 2923 and/or the retaining portion 294 pivots to increase or decrease the biasing force the third resilient member 2941 applies to the retaining portion 294. For example, the pivot point of the locking assembly 282 may have an expanded width that creates a pressure point and when a sufficient amount of backing 2923 moves proximally past the pivot point, it may release, or at least decrease, the biasing force of third resilient member 2941.

Figure 23A:
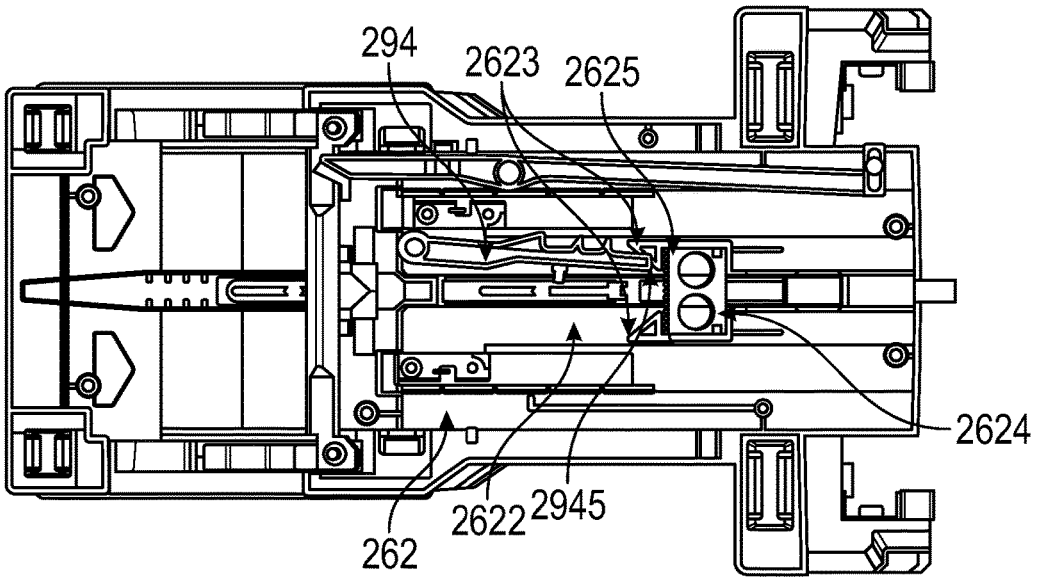
FIG. 23A shows a bottom view of a top cover of the base portion of the toy vehicle launcher of FIG. 6.

As a more specific example, and now referring to FIG. 23A, in the depicted embodiment, the bottom surface 2622 of top cover 262 includes wedges 2623 that can cause the retaining portion 294 to move laterally inwards into the engagement release position 2200, thereby causing an engagement release. The wedges 2623 are positioned to engage a distal end 2945 of the retaining portion 294 as the retaining portion 294 moves forward (e.g., after a trigger release) and are angled to create a force that overcomes the biasing force of third resilient member 2941. The wedges 2623 are also positioned between booster assemblies 290, 291 and a stop 2624 into which the booster assemblies 290, 291 can move after an engagement release. In at least some embodiments, the stop 2624, or at least an impact surface 2625 thereof, is made of and/or coated with a soft material, such as rubber and/or silicone, that reduces noise and potential impact damage from repeated launches. The impact surface 2625 may also have features, e.g., indentations, serrations, or the like, that help reduce noise and impact forces.

Figure 23B:
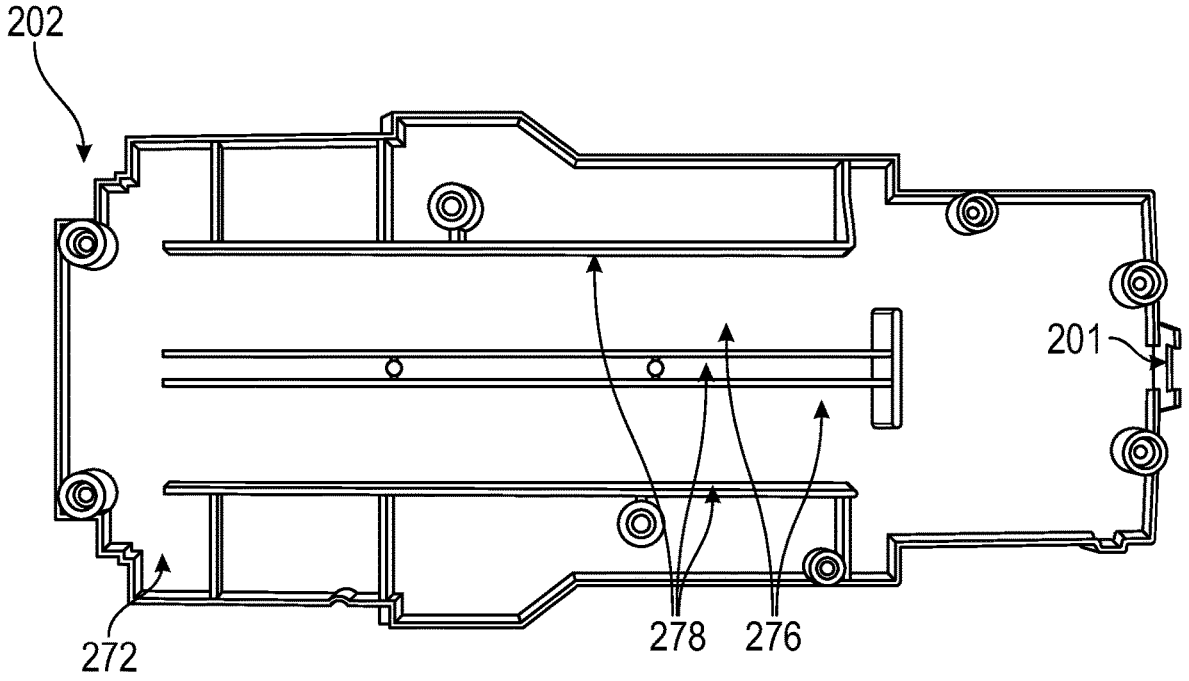
FIG. 23B shows a top view of a bottom cover of the base portion of the toy vehicle launcher of FIG. 6.

Now turning to FIG. 23B, another option for controlling interplay between the force control assembly 281, the locking assembly 282, and/or booster assemblies 290 and 291 is to specifically contour covers of the base portion 260. FIG. 23B depicts a top view of the bottom cover 272, which includes contoured supports 278 that divide and border booster channels 276. In some embodiments, the contoured supports 278 can widen towards the front 201 of the launcher 200, creating widening booster channels 276 in which booster assemblies 290 and 291 can expand to cause an engagement release during movement of the booster assemblies 290 and 291 toward the front 201. However, in the depicted embodiment, contoured supports 278 extend in a substantially parallel manner to each other and the top cover while wedges 2623 primarily cause engagement releases of the booster assemblies 290, 291.

Instead, in the depicted embodiment, the contoured supports 278 generally taper from a higher height to a lower height moving towards the back 202 of the launcher 200. This may allow the hammer subassembly 287 to travel along a sloped path during rearward movement thereof, which may help ensure that the hammer subassembly 287 stably engages booster assemblies 290 and 291 while also retaining alignment with sloped lanes 264 and 266 included on the top surface 2621 of the top cover 262 of the base portion 260. Sloped lanes 264 and 266 may encourage toy vehicles to automatically remain in contact with the extensions 2931 of the vehicle engagement members 293 of booster assemblies 290 and 291. As can be seen in FIGS. 16 and 17, in at least some embodiments, the bottom surface 2622 of top cover 262 may also have a sloped surface 268 corresponding to lanes 264 and 266 and/or to contoured supports 278.

Figure 24:
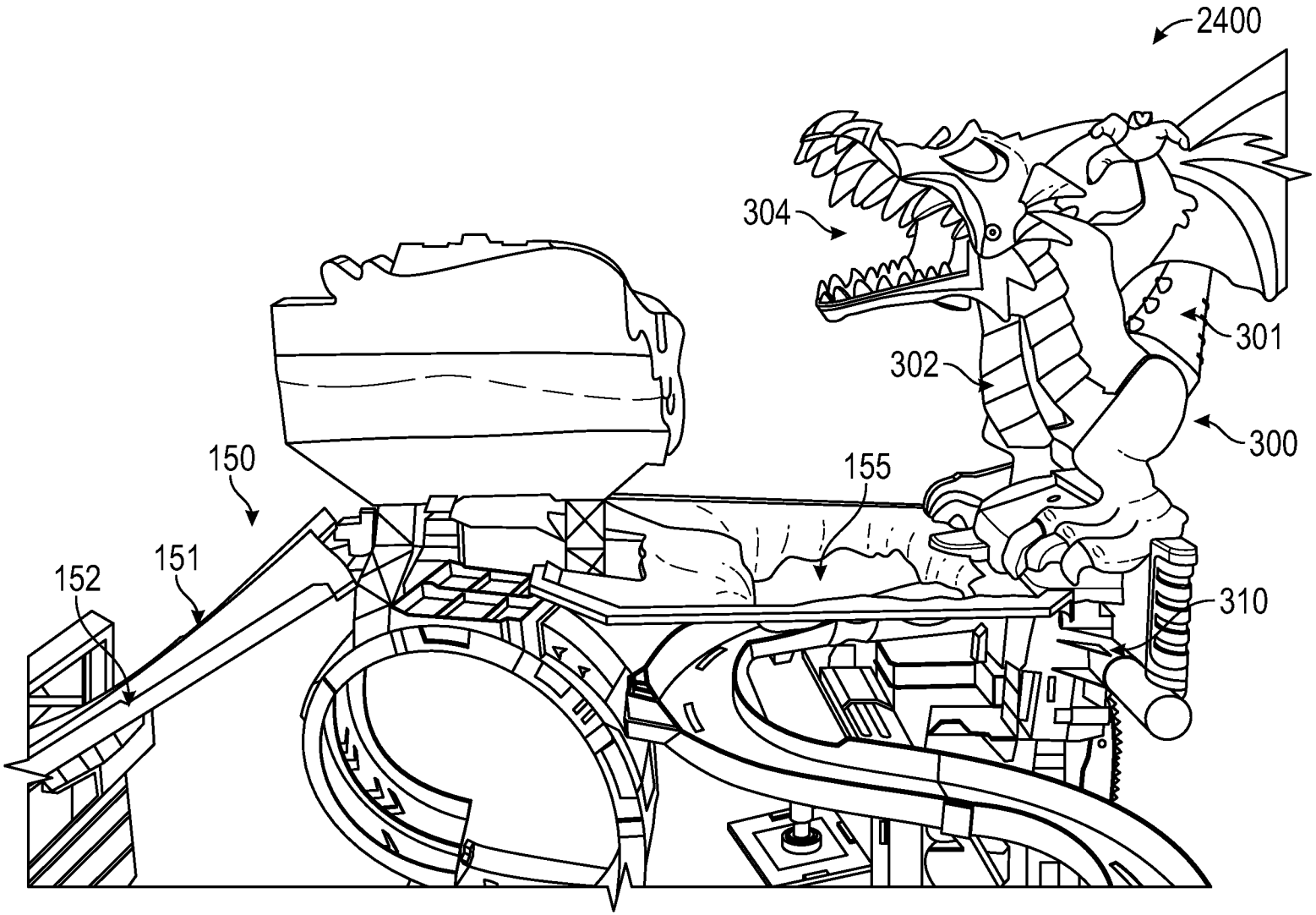
FIG. 24 illustrates a front view of a top level of the toy vehicle track set of FIG. 2.
Figure 25:
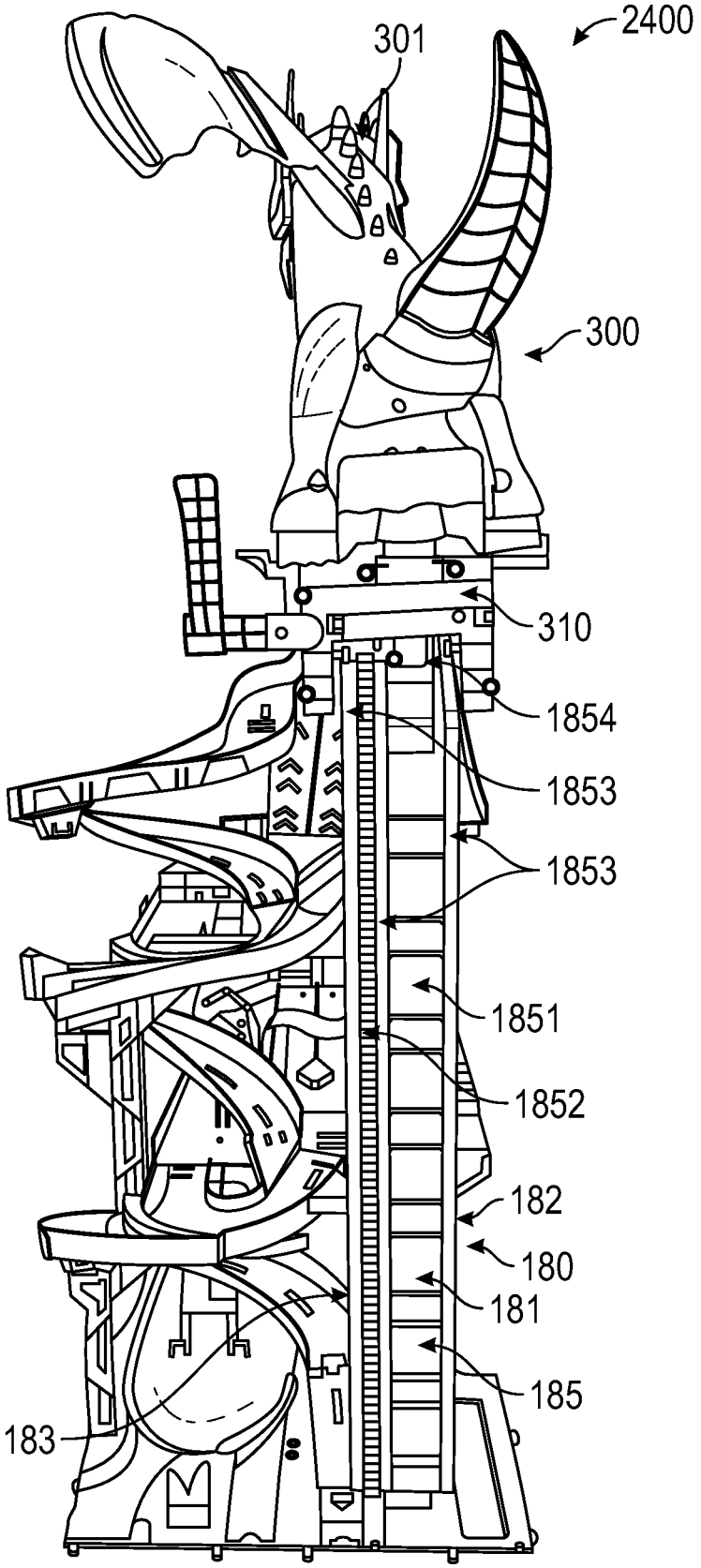
FIG. 25 illustrates a right side view of the toy vehicle track set of FIG. 2.
Figure 26:
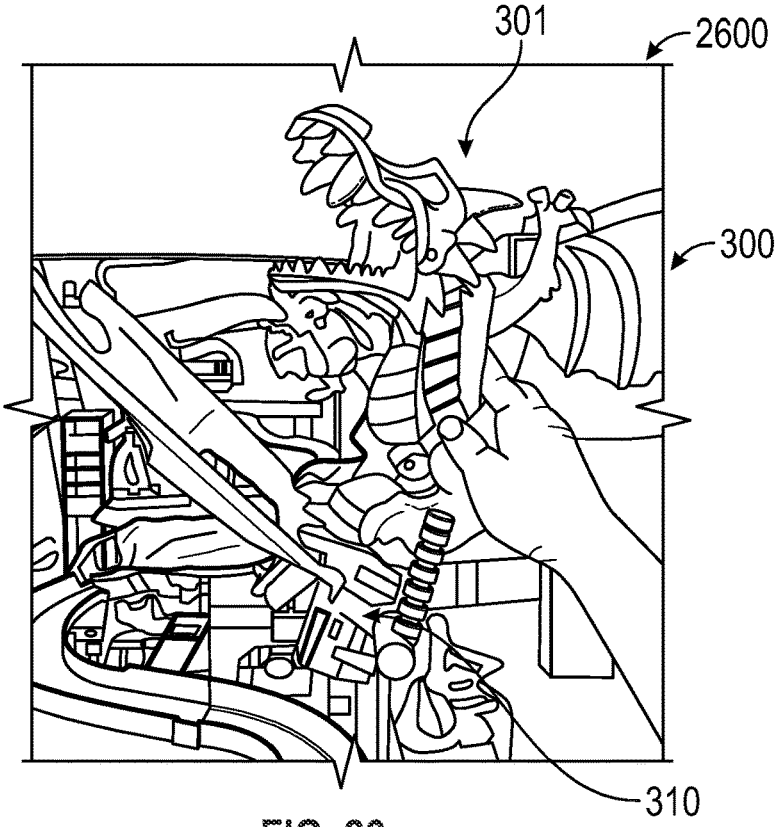
FIGS. 26 and 27 illustrate perspective views of an interactive stunt element included on a side of the top level of the toy vehicle track set of FIG. 2 during different portions of an interaction.
Figure 27:
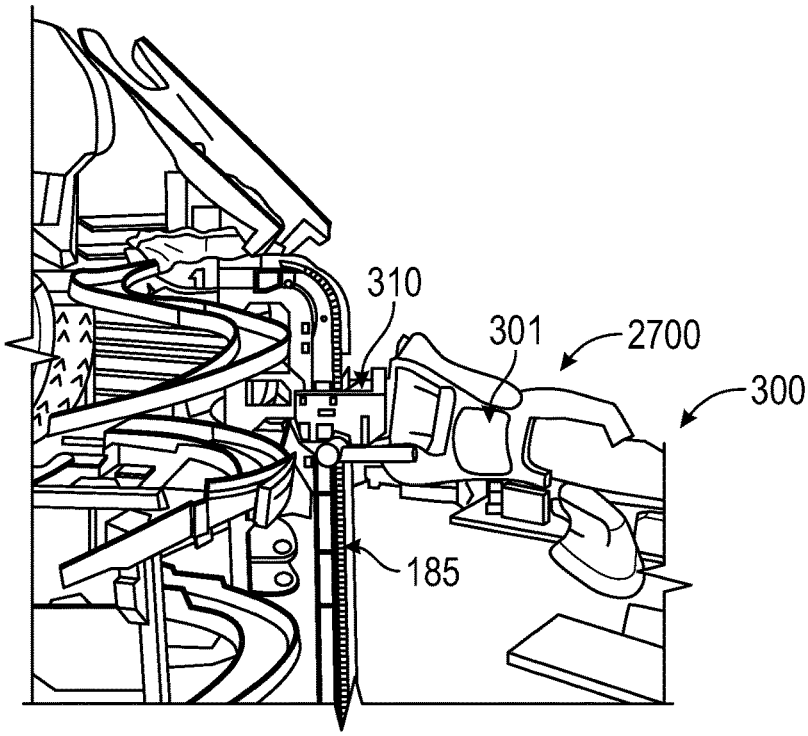
Figure 28:
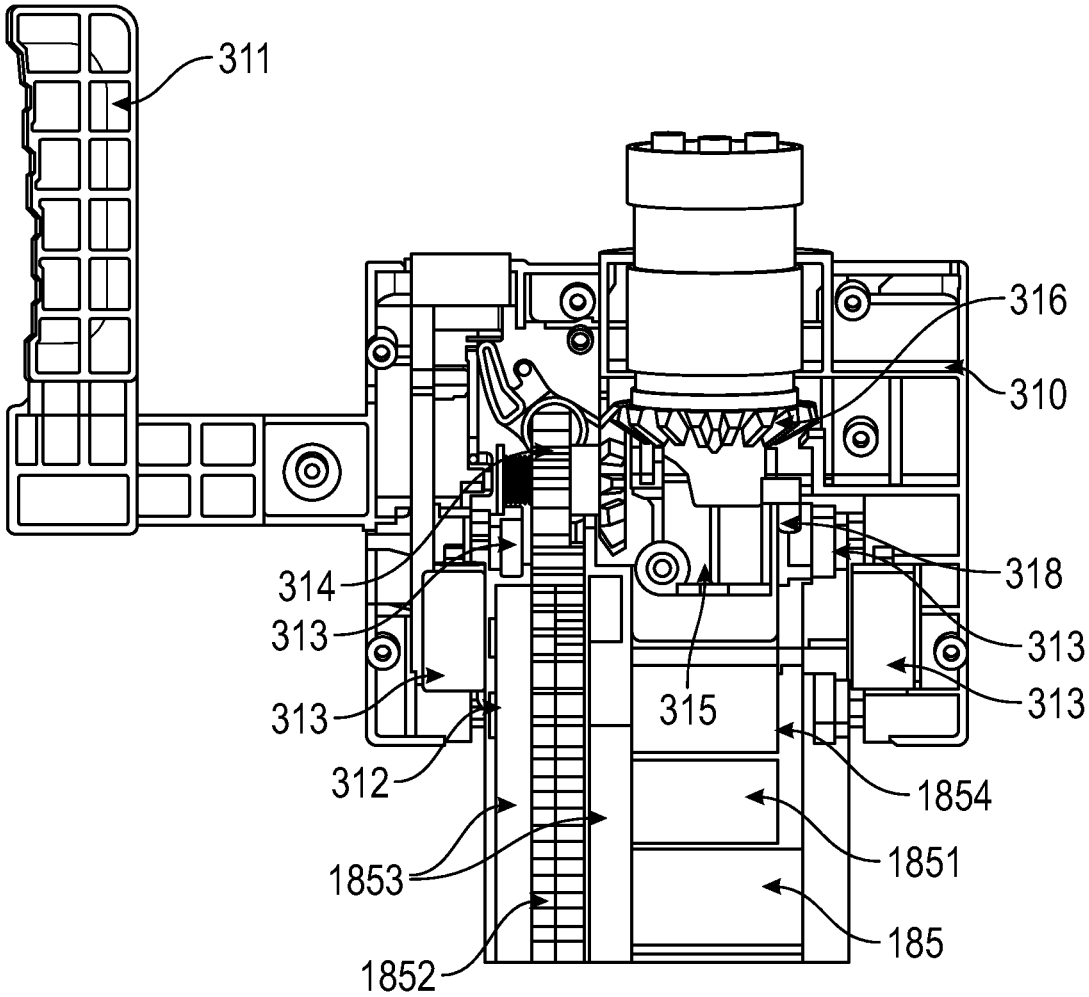
FIG. 28 illustrates a rear view of a portion of a base of the interactive stunt element.

Now turning to FIGS. 24-28, these Figures depict at least a portion of the interactive stunt element 300 of the toy vehicle track set 100, with which toy vehicles launched by the launcher 200 may interact. FIG. 24 illustrates the interactive stunt element 300 together with the top level 150 of toy vehicle track set 100 from a front 106 of the toy vehicle track set 100, but a side of the interactive stunt element 300. This is because the interactive stunt element 300 generally faces the first lane 151 and second lane 152 (also referred to as pathways) of the top level 150 when the interactive stunt element 300 is arranged in its original position 2400. FIG. 25 depicts the toy vehicle track set 100 from a second side 103 of the toy vehicle track set 100, which provides a rear view of the interactive stunt element 300. FIGS. 26 and 27 depict the toy vehicle track set 100 from a perspective of the front 106 of the toy vehicle track set 100, but show the interactive stunt element 300 during an interaction. FIG. 28 is a rear view of a portion of the interactive stunt element 300 (with a cover removed).

As can be seen in FIGS. 24-26, since the interactive stunt element 300 generally faces the first lane 151 and second lane 152 when in its original position 2400, a front of the interactive stunt element 300 is positioned in a pathway of toy vehicles launched along first lane 151 or second lane 152. In fact, in the depicted embodiment, launcher 200 is specifically tuned (e.g., based on a depth of fourth indentation 1604(4)) to launch toy vehicles into the interactive stunt element 300. The first lane 151 is specifically angled to launch toy vehicles launched by launcher 200—launched with the specific force imparted at launching position P4—towards an opening 304 included on the interactive stunt element 300. Meanwhile, the second lane 152 is specifically angled to launch toy vehicles launched by launcher 200—again, launched with the specific force imparted at launching position P4—towards an actuation panel 302 included on a main body 301 of the interactive stunt element 300.

Toy vehicles entering the opening 304 may be captured inside interactive stunt element 300 while toy vehicles hitting the actuation panel 302 may fall through funnel 155 onto trackway 158. But, at least some actuations of actuation panel 302 may cause the interactive stunt element 300 to complete an "interaction," e.g., by falling down tower 180. FIG. 26 shows the interactive stunt element 300 in a tilted position 2600, where it is beginning an interaction. FIG. 27 shows the interactive stunt element 300 in a falling position 2700, where it is spinning while falling down tower 180. Spinning may be driven when a base 310 of the interactive stunt element 300 engages with features of tower 180.

More specifically, and now turning to FIG. 25, in the depicted embodiment, the interactive stunt element 300 includes a base 310 that substantially surrounds and movably engages the tower 180. Generally, the second tower 180 includes an outer stanchion 181 with a front face 182, a back face 183, and a side face 185. The base 310 generally extends to and movably engages the front face 182 and back face 183 (e.g., via rollers), while the side face 185 includes features that drive the interaction and positioning of the interactive stunt element 300. In particular, the side face 185 includes a channel 1851 that is bounded by smooth tracks 1853 and also includes a toothed track 1852 that, in the depicted embodiment, is positioned within one of the smooth tracks 1853. Finally, near a top of the tower 180, the side face 185 includes an alignment track 1854. The alignment track 1854 is generally configured to reposition the interactive stunt element 300 to its original orientation when a user lifts the interactive stunt element 300 back to its original position 2400.

The base 310 generally includes features to mate with and/or interact with features of the tower 180. For example, as is best seen in FIG. 28 (which removes an outer cover), the base 310 extends around a guide channel 312 that is configured to receive the outer stanchion 181 (extending around the front face 182 to the back face 183) and also includes a handle 311, rollers 313, a gear 314, a mount 315, and a rotational gear 316. The rollers 313 are configured to engage the smooth tracks 1853, the front face 182, and/or the back face 183 to guide movement of the interactive stunt element 300 along the tower 180. Meanwhile, the gear 314 is configured to engage the toothed track 1852 of the tower 180 and can be linked to rotational gear 316, which is configured to rotate the main body 301 of the interactive stunt element 300 when rotated. Thus, the rotational gear 316 may sit within and be coupled to a mount 315 that is coupled to the main body 301 of the interactive stunt element 300.

The mount 315 may support the main body 301 for rotation with respect to the base 310, but may otherwise stably support the main body 301. In some instances, this may mean that the main body 301 is fixed to the mount 315, which rotates within base 310. However, in other instances, the main body 301 of the interactive stunt element 300 may also be movable with respect to the base 310. For example, the main body 301 may tilt with respect to base 310 and then travel therewith while rotating. In any case, the mount 315 may also extend into the channel 1851 to create a further support for the main body 301 during rotation thereof.

The handle 311 generally extends from the main body and allows a user to easily pick up the interactive stunt element 300 to translate it up the tower 180 after an interaction (e.g., to roll the interactive stunt element 300 up the tower 180). In some embodiments, the handle 311 may be oriented such that grabbing the handle and pulling the interactive stunt element 300 upwards via the handle causes a rotation of handle 311. This rotation may, but need not, act as a clutch for gear 314, moving the gear 314 out of alignment with toothed track 1852. Additionally or alternatively, the mount 315 and/or the rotational gear 316 may support an alignment protrusion 318. The alignment protrusion 318 is configured to help return the main body 301 of the interactive stunt element 300 to its original position 2400. More specifically, the mount 315 and the alignment protrusion 318 are shaped such that as the base 310 approaches the top of the tower 180, the alignment protrusion 318 will be forced into contact with the alignment track 1854 and will be retained in such a position. With the alignment protrusion 318 positioned as such, the main body 301 of the interactive stunt element 300 will automatically right itself by rotating into its original position 2400 (with its original orientation).

While the toy vehicle launcher and a track set including the same presented herein, as well as portions thereof, have has been illustrated and described in detail and with reference to specific embodiments thereof, it is nevertheless not intended to be limited to the details shown. Instead, it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicle launcher and a track set including the same described herein, or portions thereof, may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A toy vehicle track set comprising:

one or more vehicle pathways; and a toy vehicle launcher that is movable to a plurality of launching locations disposed along the one or more vehicle pathways, wherein the toy vehicle launcher is configured to impart a launching force to a toy vehicle when the toy vehicle launcher is disposed in one of the plurality of launching locations, and the toy vehicle launcher is configured to prevent the launching force from being imparted to the toy vehicle while the toy vehicle launcher is moving between the plurality of launching locations, wherein the toy vehicle launcher includes a force control assembly that automatically controls the launching force of the toy vehicle launcher based on different interactions with a control strip at different locations of the plurality of launching locations to cause the launching force to have different magnitudes at the different locations of the plurality of launching locations.

2. The toy vehicle track set of claim 1, wherein the toy vehicle track set comprises a tower along which the toy vehicle launcher is vertically movable, the tower including a plurality of grooves to define the plurality of launching locations.

3. The toy vehicle track set of claim 2, wherein the plurality of grooves also define one or more non-launching locations, and the tower includes a stop associated with each groove of the plurality of grooves defining one of the plurality of launching locations.

4. The toy vehicle track set of claim 3, wherein the toy vehicle launcher includes a locking assembly that prevents the toy vehicle launcher from moving, wherein each stop is configured to engage the locking assembly while the toy vehicle launcher imparts the launching force to the toy vehicle.

5. The toy vehicle track set of claim 2, wherein the tower includes indentations associated with each groove of the plurality of grooves defining one of the plurality of launching locations on the control strip.

6. The toy vehicle track set of claim 5, wherein each indentation is configured to activate the force control assembly so that the toy vehicle launcher can impart the launching force to the toy vehicle.

7. The toy vehicle track set of claim 1, wherein the toy vehicle launcher comprises one or more triggers that are actuatable at or between the plurality of launching locations, wherein trigger actuations initiated while the toy vehicle is between the plurality of launching locations do not cause the toy vehicle to create the launching force.

8. A toy vehicle track set comprising:

one or more vehicle pathways;

a toy vehicle launcher that is movable to at least two locations disposed along the one or more vehicle pathways, wherein at different locations of the at least two locations, the toy vehicle launcher is configured to impart different launching forces of different magnitudes to a toy vehicle on which the toy vehicle launcher is acting; and a tower along which the toy vehicle launcher is vertically movable and the tower defines the different locations to be vertically spaced along a height of the tower.

9. The toy vehicle track set of claim 8, wherein the different locations are vertically spaced between a base and a top of the toy vehicle track set and the different magnitudes increase as the toy vehicle launcher moves from the base of the toy vehicle track set to the top of the toy vehicle track set.

10. The toy vehicle track set of claim 8, wherein the tower includes a control strip with indentations of different depths arranged along the height of the tower and an indentation depth is configured to control a magnitude of the different launching forces at the different locations.

11. The toy vehicle track set of claim 10, wherein the toy vehicle launcher includes a force control assembly that mechanically controls a magnitude of a particular launching force that the toy vehicle launcher imparts to the toy vehicle when a portion of the force control assembly moves into a particular indentation of the indentations.

12. A toy vehicle track set comprising:

a toy vehicle launcher that is movable to at least two locations disposed along one or more vehicle pathways, wherein at different locations of the at least two locations, the toy vehicle launcher is configured to impart different launching forces of different magnitudes to a toy vehicle on which the toy vehicle launcher is acting, the different launching forces being determined by physical characteristics associated with the different locations of the toy vehicle launcher; wherein the one or more vehicle pathways comprise:

a first track pathway having a track length, wherein the toy vehicle launcher is configured to impart a first launching force of a first magnitude to the toy vehicle when the toy vehicle launcher is aligned with the first track pathway, the first launching force being sufficient to allow the toy vehicle to traverse the track length; and a second track pathway including a stunt, wherein the toy vehicle launcher is configured to impart a second launching force of a second magnitude to the toy vehicle when the toy vehicle launcher is aligned with the second track pathway, the second launching force being sufficient to allow the toy vehicle to complete the stunt.

13. The toy vehicle track set of claim 12, wherein the stunt is a loop or an interaction with an interactive stunt element.

14. A launcher for a toy vehicle comprising:

a handle portion including one or more triggers;

a rider portion configured to movably couple the launcher to a toy vehicle track or a toy vehicle track set;

a base configured to support a toy vehicle; and a launching mechanism configured to control a force imparted to the toy vehicle on the base in response to selective actuations of at least one of the one or more triggers, wherein the launching mechanism comprises:

a locking assembly that prevents the launcher from moving while the force is imparted to the toy vehicle; and a force control assembly that limits a maximum magnitude of the force imparted to the toy vehicle, the maximum magnitude being variable based on a position of the launcher.

15. The launcher of claim 14, wherein the base comprises:

a first lane for a first toy vehicle; and a second lane for a second toy vehicle.

16. The launcher of claim 15, wherein the launching mechanism comprises:

a first booster assembly that interacts with the first toy vehicle in the first lane; and a second booster assembly that interacts with the second toy vehicle in the second lane; the first booster assembly and the second booster assembly being actuatable based on: (a) a state of the launching mechanism; and (b) actuations of the one or more triggers.

17. The launcher of claim 16, wherein the first booster assembly and the second booster assembly are operable jointly or separably.

18. A toy vehicle track set comprising:

one or more vehicle pathways;

a toy vehicle launcher that is movable to a plurality of launching locations disposed along the one or more vehicle pathways, wherein the toy vehicle launcher is configured to impart a launching force to a toy vehicle when the toy vehicle launcher is disposed in one of the plurality of launching locations, and the toy vehicle launcher is configured to prevent the launching force from being imparted to the toy vehicle while the toy vehicle launcher is moving between the plurality of launching locations; and a tower along which the toy vehicle launcher is vertically movable, the tower including a plurality of grooves to define the plurality of launching locations and one or more non-launching locations, and the tower includes a stop associated with each groove of the plurality of grooves defining one of the plurality of launching locations, wherein the toy vehicle launcher includes a locking assembly and each stop is configured to engage the locking assembly while the toy vehicle launcher imparts the launching force to the toy vehicle to prevent the toy vehicle launcher from moving during impartation of the launching force.

19. A toy vehicle track set comprising:

one or more vehicle pathways;

a toy vehicle launcher that is movable to a plurality of launching locations disposed along the one or more vehicle pathways, wherein the toy vehicle launcher is configured to impart a launching force to a toy vehicle when the toy vehicle launcher is disposed in one of the plurality of launching locations, and the toy vehicle launcher is configured to prevent the launching force from being imparted to the toy vehicle while the toy vehicle launcher is moving between the plurality of launching locations; and a tower along which the toy vehicle launcher is vertically movable, the tower including a plurality of grooves to define the plurality of launching locations and a control strip with indentations associated with each groove of the plurality of grooves, wherein the toy vehicle launcher includes a force control assembly and each indentation is configured to activate the force control assembly so that the toy vehicle launcher can impart the launching force to the toy vehicle.

20. The toy vehicle track set of claim 19, wherein the toy vehicle launcher comprises one or more triggers that are actuatable at or between the plurality of launching locations, wherein trigger actuations initiated while the toy vehicle is between the plurality of launching locations do not cause the toy vehicle to create the launching force.

* * * * *